US006145145A

United States Patent [19]

Besel

[11] Patent Number: 6,145,145

[45] Date of Patent: Nov. 14, 2000

[54] APPARATUS HAVING A BELT AGITATOR FOR AGITATING A CLEANING AGENT INTO A CARPET

[75] Inventor: Arlen Dale Besel, Elkton, Md.

[73] Assignee: E. I. du Pont de Nemours and Company, Wilmington, Del.

[21] Appl. No.: 09/282,504

[22] Filed: Mar. 31, 1999

Related U.S. Application Data

[63] Continuation-in-part of application No. 08/950,915, Oct. 15, 1997, abandoned, which is a continuation-in-part of application No. 08/808,695, Feb. 28, 1997, abandoned.

[51] Int. Cl.[7] ..... A47L 11/29

[52] U.S. Cl. ..... 15/22.3; 15/49.1; 15/380

[58] Field of Search ..... 15/380, 363, 50.1, 15/49.1, 22.3

[56] References Cited

U.S. PATENT DOCUMENTS

| | | | |
|---|---|---|---|
| 793,234 | 6/1905 | Scanlan | 15/22.3 |
| 1,689,497 | 10/1928 | Morgal | 15/380 |
| 1,882,270 | 10/1932 | Beach | 15/49.1 |
| 2,524,928 | 10/1950 | Platz | 15/380 X |
| 3,158,885 | 12/1964 | Kammann et al. | 15/51 |
| 3,686,699 | 8/1972 | Knestele | 15/50.1 |
| 4,173,054 | 11/1979 | Ando | 15/98 |
| 4,506,405 | 3/1985 | Block . | |
| 4,642,831 | 2/1987 | Roth | 15/49.1 X |
| 4,914,773 | 4/1990 | Ham | 15/49.1 X |
| 5,016,313 | 5/1991 | Yonehara | 15/380 X |
| 5,155,876 | 10/1992 | Whitaker . | |
| 5,194,077 | 3/1993 | Bargiel et al. . | |
| 5,383,251 | 1/1995 | Whitaker et al. . | |
| 5,477,580 | 12/1995 | Buysse . | |
| 5,509,162 | 4/1996 | Burgoon . | |
| 5,515,770 | 5/1996 | Clark et al. . | |
| 5,575,710 | 11/1996 | Kramer . | |
| 5,588,179 | 12/1996 | Bargiel et al. . | |
| 5,605,493 | 2/1997 | Donatelli et al. . | |
| 5,623,743 | 1/1997 | Burgoon et al. . | |

FOREIGN PATENT DOCUMENTS

| | | |
|---|---|---|
| 286328 | 10/1988 | European Pat. Off. . |
| 1947132 | 4/1971 | Germany . |
| WO 97/00115 | 1/1997 | WIPO . |

*Primary Examiner*—Chris K. Moore

[57] ABSTRACT

Apparatus for agitating a cleaning agent into a carpet comprises a housing within which a first and a second roller are each mounted for rotation in a first angular direction. A platen is mounted intermediate the rollers. A belt agitator comprising a fabric substrate having a pile surface is trained about the first and second rollers and extends under the platen. The rollers the platen support rectilinear movement of the belt agitator in the first direction to bring a portion of its surface sequentially from a first position within the housing to a contacting position in which the portion of the surface is in agitating contact with a carpet and, thereafter, to a second position within the housing.

36 Claims, 18 Drawing Sheets

APPARATUS HAVING A BELT AGITATOR FOR AGITATING A CLEANING AGENT INTO A CARPET

CROSS REFERENCE TO OF THE INVENTION

This application is a continuation-in-part of application Ser. No. 08/950,915, filed Oct. 15, 1997, (RD-7255-A), abandoned which is itself a continuation-in-part of application Ser. No. 08/808,695, filed Feb. 28, 1997, (RD-7255) abandoned.

BACKGROUND OF THE INVENTION

1. Field of the Invention

The present invention relates to an apparatus having a belt agitator for agitating a cleaning agent into a carpet.

2. Description of the Prior Art

A well-known apparatus for cleaning carpet is the so-called "bonnet" cleaning apparatus. A bonnet cleaning apparatus uses an applicator pad that is placed under a plate-mounted brush. The brush rotates about an axis that is substantially vertical with respect to the carpet being cleaned. Rotation of the brush causes the pad to rotate in a generally circular path over the carpet. A cleaning agent is sprayed directly onto the carpet and onto the applicator pad. The pad, moving in a circular direction with respect to the surface of the carpet, agitates the cleaning agent into the carpet. There is some difference of opinion as to whether the rotation of the applicator pad as described has a deleterious effect on the ply-twisted pile of the carpet.

In view of the foregoing it is believed to be advantageous to provide an agitating apparatus for applying a cleaning agent to a carpet using an agitating motion that is substantially rectilinearly parallel to the pile surface of the carpet.

SUMMARY OF THE INVENTION

The present invention is directed broadly to an apparatus having a belt agitator that is rectilinearly movable in a direction that is substantially parallel to the pile surface of the carpet for agitating a cleaning agent (preferably in liquid or foam form) into a carpet. The apparatus comprises a housing within which a first roller and a second roller are each mounted within the housing for rotation in a first angular direction. A platen is mounted within the housing intermediate the first and second rollers. A belt agitator is trained about the first and second rollers and extends under the platen. The belt agitator comprises a fabric substrate having a pile surface attached on the exterior thereof. The rollers and the platen support rectilinear movement of the belt agitator in the first direction to bring a portion of its surface sequentially from a first position within the housing to a contacting position in which the portion of the surface is in agitating contact with a carpet and, thereafter, to a second position within the housing.

A suction head is disposed within the housing at a position proximal to the second position. The suction head removes from the fabric surface soil lifted from the carpet as a result of contact with the carpet. The forward lip of the suction head may be positioned to contact the surface of the belt agitator. A pile lifting roller having a pile lifting bristle brush thereon is mounted within the housing for rotation in a second, opposing, angular direction. The pile lifting brush also engages against the surface of the belt agitator and tends to loosen any matter carried on the belt agitator. The trailing lip of the suction head may also be positioned to contact the bristles on the pile lifting brush to cause particulate matter to be ejected for collection by the suction. A dispenser for the cleaning agent is mounted to the housing in a position wherein a cleaning agent is dispensed onto the carpet surface, and, also, onto the surface of the belt agitator.

The motive source for rotatably driving one of the rollers and the pile lifting roller may be disposed within the hollow interior of each of these rollers.

A three-roller embodiment of the invention is also disclosed.

A source of vibratory motion may be provided for oscillating the platen in its own plane with respect to the housing. The oscillation of the platen is imparted as additional vibratory motion to the belt as it moves beneath the platen.

BRIEF DESCRIPTION OF THE DRAWING

The invention will be more fully understood from the following detailed description, taken in connection with the accompanying drawing, in which:

FIG. 3A is a rear elevational taken along section lines 3—3, while

FIG. 10A is a top sectional view (taken along section lines 10A—10A in FIG. 10B) showing a second alternate, more compact, embodiment of the apparatus of the present invention, while FIG. 11A is a side sectional view showing a first embodiment of a modification to an apparatus of the present invention in which the platen supporting the belt agitator is itself mounted for orbital vibratory movement in its plane, while

FIG. 11C is a front sectional view (i. e., a view taken in the direction transverse to the view of FIG. 11A) showing a second embodiment of the modification to an apparatus of the present invention in which the platen supporting the belt agitator is itself mounted for reciprocating vibratory movement in its plane, while

DETAILED DESCRIPTION OF THE INVENTION

Figure 1:
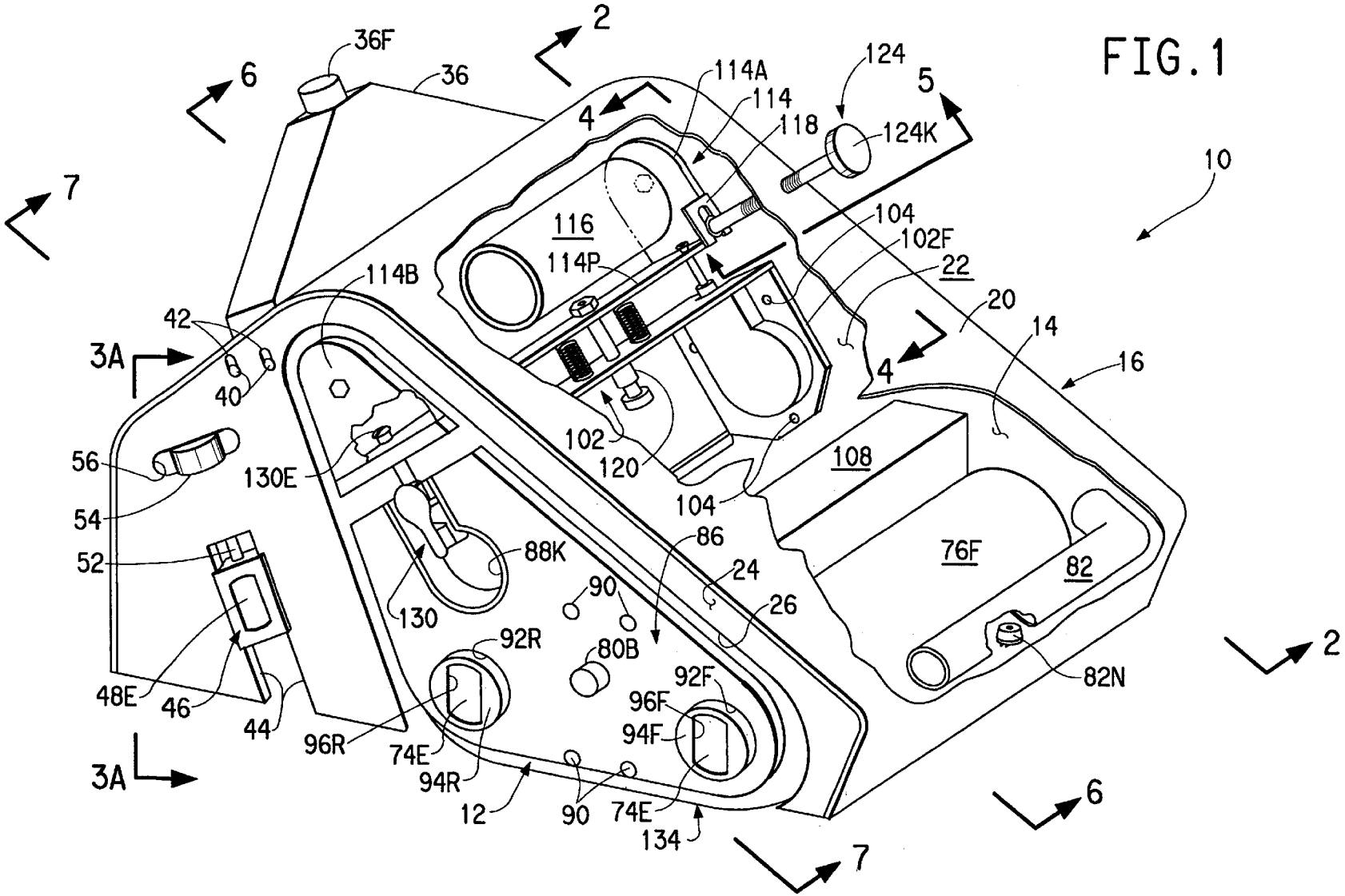
FIG. 1 is a perspective view of an apparatus having a belt agitator for agitating a cleaning agent into a carpet in accordance with the present invention, portions of the cover of the housing being removed for clarity of illustration.

Throughout the following detailed description, similar reference numerals refer to similar elements in all Figures of the drawings.

FIG. 1 is a perspective view of an agitating apparatus generally indicated by the reference character 10 in accordance with the present invention. The heart of the apparatus 10 is a belt agitator 134 (FIG. 6) for agitating a cleaning agent into a carpet. The belt agitator 134 is removably mounted in a belt module generally indicated by the reference character 12 (best seen in FIGS. 1 and 6). The belt module 12 is itself received in the interior volume 14 defined within the housing 16 of the apparatus 10.

The housing 16 of the agitating apparatus 10 is formed from a hollow, dome-like, cover member 20 that is attached at each of its lateral edges, as by welding, to one of a pair of confronting sidewalls 22, 24. The sidewall 22 (the interior surface of which is seen in elevation in FIG. 2) substantially entirely closes one lateral side of the housing 16. However, as seen in FIG. 1, the other lateral sidewall 24 of the housing 16 has a rather substantial cutout 26 formed therein. The cutout 26 defines an access opening through which the belt module 12 may be inserted into the interior volume 14 of the housing 12. Front and rear bumpers 28 (FIGS. 6 and 7) are mounted to the cover 20.

The upper region of the structure of the housing 16 is stiffened by a brace bar 30 (FIGS. 2 and 6) that extends transversely between the sidewalls 22, 24. The brace bar 30 is welded to the inside surface of the cover 20, as well as the inside surfaces of the sidewalls 22, 24. Further stiffening to the housing adjacent to the trailing end thereof is imparted by an L-shaped channel member 32 (FIGS. 2, 3B and 6) that extends transversely between the sidewalls 22, 24. An access opening 34 (e. g., FIG. 6) for a tracking screw 124 (FIG. 5) is provided in the cover 20 for a purpose to be explained hereafter. An access opening 35 (FIG. 6) for a cleaning agent hose 84 is also provided in the cover 20.

Figure 2:
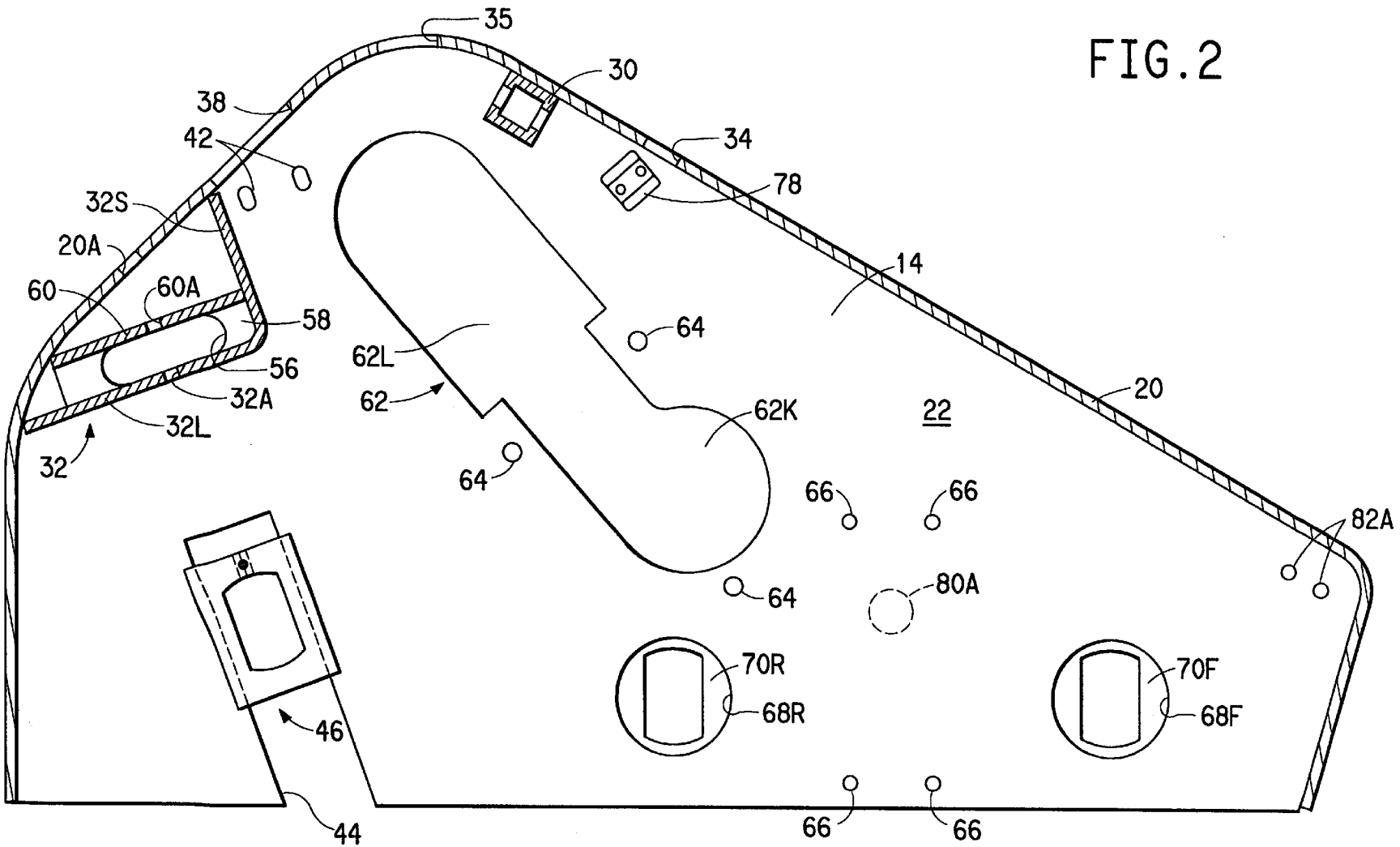
FIG. 2 is a side elevational and partial sectional view taken along section lines 2—2 of FIG. 1 illustrating the inside surface of the back sidewall of the apparatus as the same is viewed in FIG. 1.
Figure 6:
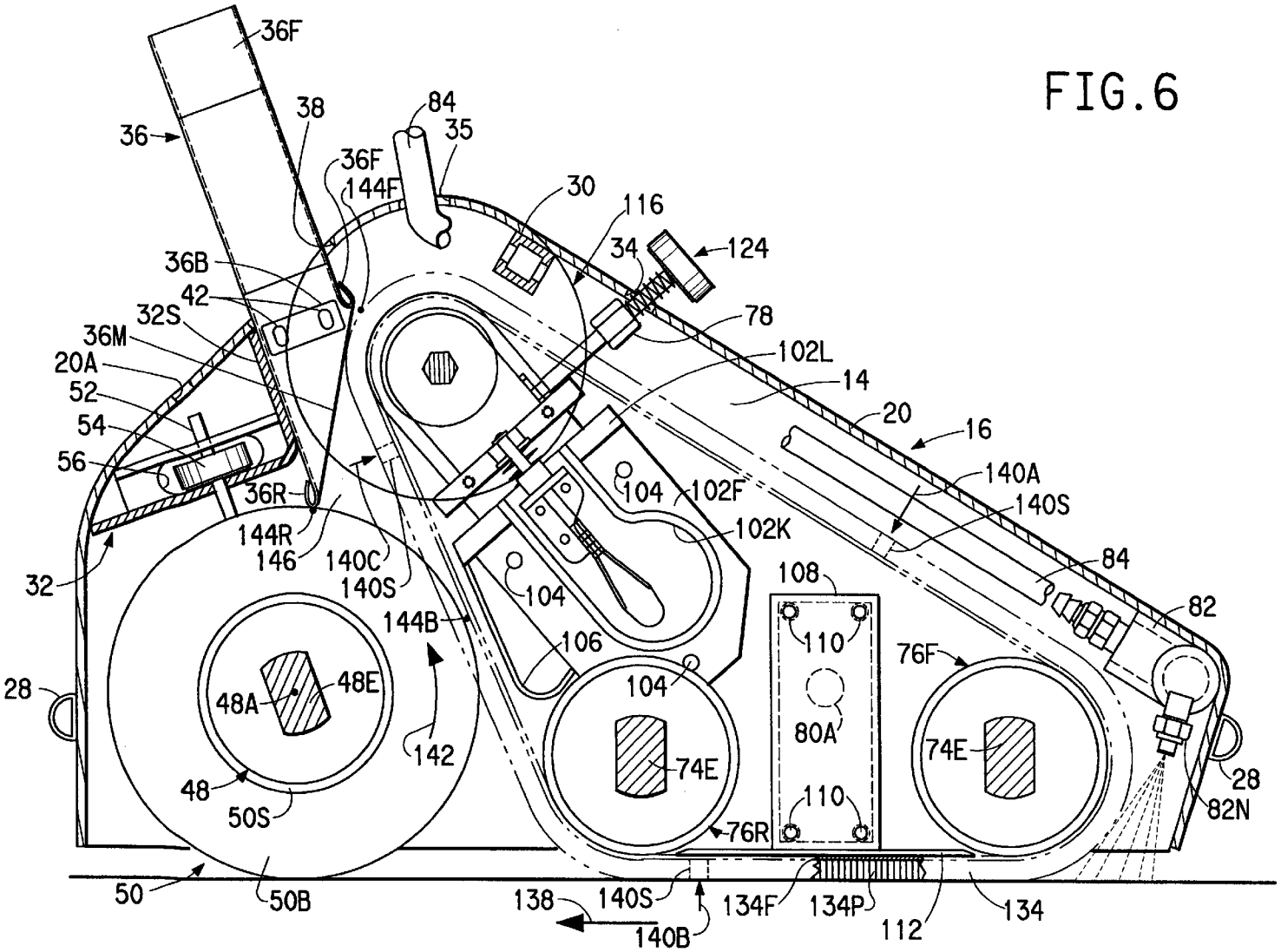
FIG. 6 is a side elevational view partially in section of the overall assembly of the apparatus of FIG. 1 taken along section lines 6—6 therein.

A suction shroud 36 extends through an opening 38 provided in the central region of the cover 20 such that the mouth 36M (FIG. 6) of the shroud 36 communicates with the interior volume 14 of the housing 16. The shroud has a fitting 36F thereon, whereby the shroud may be connected to a low pressure suction source. The low pressure suction source may be conveniently located adjacent to the work area or may be carried by an operator. The transverse edges surrounding the mouth 36M of the shroud 36 are folded back to provide to define stiff, transversely extending lips 36F, 36R for a purpose to be described. As seen in FIG. 6 the rear transverse surface of the shroud 36 rests against and is supported by the short leg 32S of the channel member 32. Each lateral end of the shroud 36 has threaded mounting blocks 36B (FIG. 6) thereon. Mounting bolts 40 are inserted through elongated slots 42 provided in the sidewalls 22, 24 (FIG. 2). The bolts 40 thread into the mounting blocks 36B. The relative position of the bolts 40 along the elongated slots 42 selectably adjusts the degree of penetration of the shroud 36 into the interior volume 14 of the housing 16.

Figure 3A:
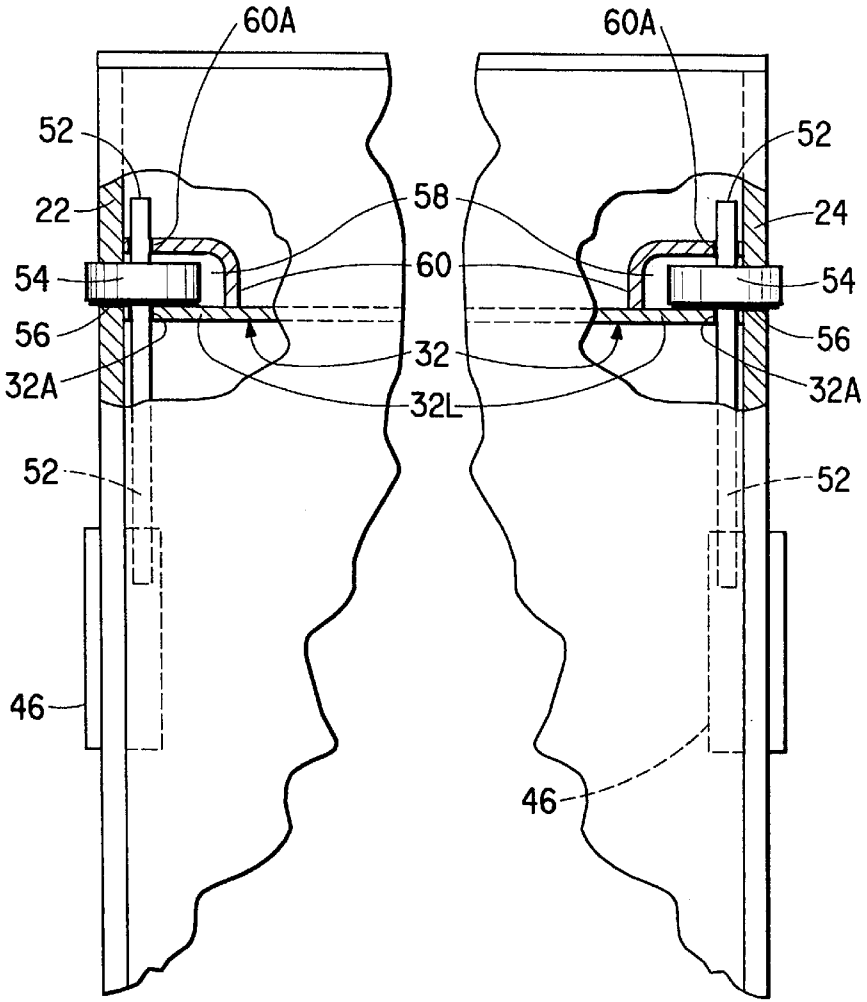
Figure 3B:
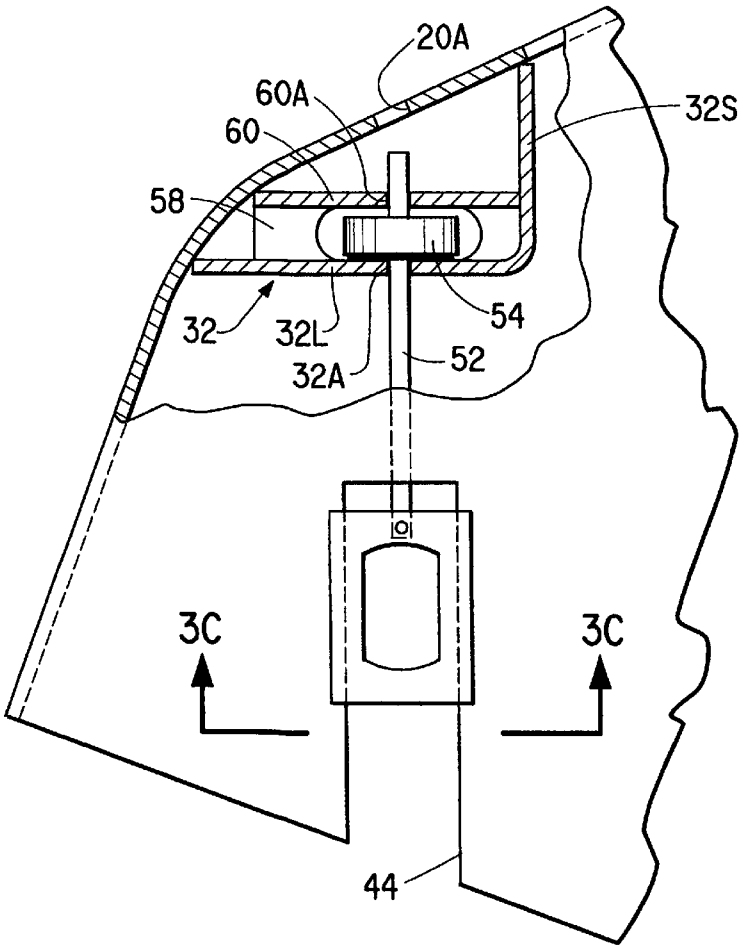
FIGS. 3B and 3C are side elevational and bottom views taken along respective section lines 3B—3B and 3C—3C of FIG. 3A, all of which illustrate the mounting arrangement for a pile lifting roller with respect to the housing of the apparatus of the present invention.
Figure 3C:
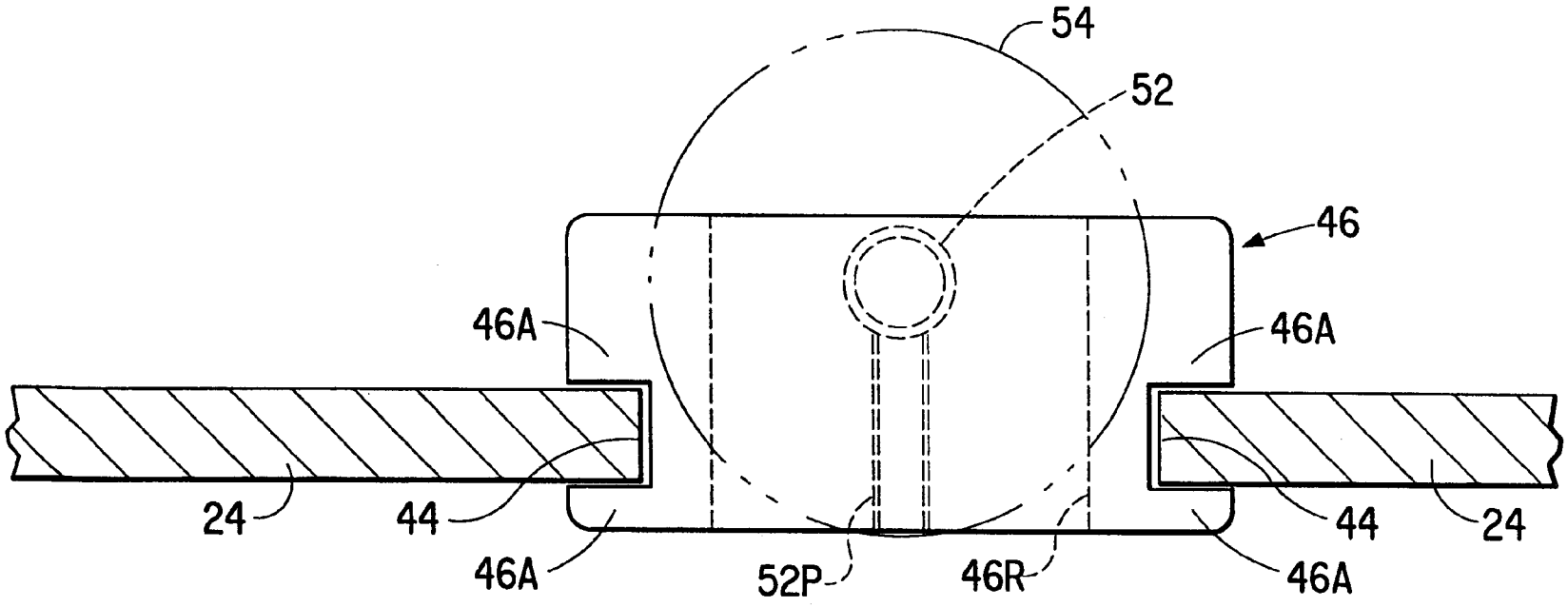

The rearward margins of the sidewalls 22, 24 each have an upwardly inclined slot 44 formed therein. A mounting block 46 is received for slidable movement along the slot 44. As is best illustrated in FIG. 3C for the case of the sidewall 24 the forward and rearward surfaces of the block 46 each have a pair of arms 46A that engage the inside and outside surfaces of the sidewall 24, (and, in an analogous manner, the sidewall 22) to confine the block 46 to sliding motion along the surfaces of the sidewalls defining the slot 44. Each block 46 has an axle-receiving opening 46R therethrough. The opening 46R corresponds in shape to the shape of axles 48E projecting from each transverse end of a driven roller 48 (to be described). For a purpose that is also described fully herein the roller 48 carries a brush 50 (FIG. 6) formed by a tubular sleeve 50S covered with stiff bristles 50B. Because of its density a crimped channel bristle brush 50 is preferred. The details of the bristles 50B are omitted for clarity of illustration.

The relative position of the axis 48A of the roll 48 along the slot 44 is adjustably controlled using a threaded rod 52 that extends upwardly from the block 46. The rod 52 is attached to the block 46 by a set pin 52P (FIG. 3C). The upper end of the rod 52 is engaged by a knurled thumbwheel 54. The thumbwheel 54 is accessible through a window 56 formed in the sidewalls 22, 24. As is best seen in FIGS. 3A and 3B, the thumbwheel 54 is captured in a pocket 58. The pocket 58 is defined between the top surface of the long leg 32L of the channel 32 and the underside of a flange 60. Each flange 60 is affixed to the top surface of the leg 32L adjacent to each lateral end of the channel 32. The channel 32, as well as the flanges 60 and the cover 20, have holes 32A, 60A and 20A, respectively, through which the threaded rod 52 extends or may extend (in the case of the opening 20A, FIG. 3B), if the need arises. Rotation of the thumbwheel 54 raises or lowers the block 46 associated therewith along the slot 44, thus controlling the position occupied by the roller 48 within the housing 14.

As is best viewed in FIG. 2 the sidewall 22 has a slot 62 formed from an upper, rounded oblong portion 62L and a lower, generally keyhole-like, portion 62K. An array of bolt holes 64 extends through the sidewall 22 in the vicinity of the keyhole-like lower portion 62K of the slot 62. A second array of bolt openings 66 is also formed in the sidewall 22, for a purpose to be explained. The sidewall 22 has a forward and rearward bores 68F, 68R therethrough. The bores 68F, 68R accept sleeves 70F, 70R each of which has an axle opening 72F, 72R, respectively, that corresponds in shape to the shape of axles 74E that project from each transverse end of a forward and a rearward belt support roller 76F, 76R, respectively (FIG. 6). A nut 78 for the tracking screw 124 (itself best seen in FIG. 5) is bolted to the interior surface of the sidewall 22 adjacent the access opening 34 in the cover 20. The exterior surface of the sidewall 22 has a trunnion 80A thereon.

A dispenser bar 82 for a liquid or foam cleaning agent extends transversely across the interior of the housing adjacent the forward end thereof. The dispenser bar 82 is attached to the sidewall 22 by bolts (not shown) that extend through openings 82A in the sidewall 22. The bolts are received in an abutment (not shown) that is provided at the end of the bar 82. The dispenser bar 82 is connected via suitable hosing 84 to a reservoir (not shown). The hosing 84 extends along the inside surface of the sidewall 22 and exits the housing 16 via the opening 35 in the cover 20. The cleaning agent reservoir may conveniently mounted, as, for example, at the same location on which the suction source is mounted, or it may be carried by an operator. The cleaning agent delivered to the dispenser bar 82 is sprayed under pressure through suitable liquid spray nozzles 82N. As is best seen in FIG. 6 the nozzles 82N are arranged to deliver a spray of cleaning agent to both the surface of the belt agitator 134 as well as to the carpet being cleaned. Any suitable cleaning liquid can be used, although the liquid cleaning formulations disclosed and claimed in U.S. Pat. No. 6,010,539, issued Jan. 4, 2000 and in PCT Published Application WO 98/18892, published May, 7, 1998 and in U.S. Pat. Nos. 5,001,004, 4,948,650 and 4,883,839 are preferred. Each of these applications and patents is assigned to the assignee of the present application. A foam cleaning agent may also be dispensed through orifices in the dispenser bar 82.

Figure 7:
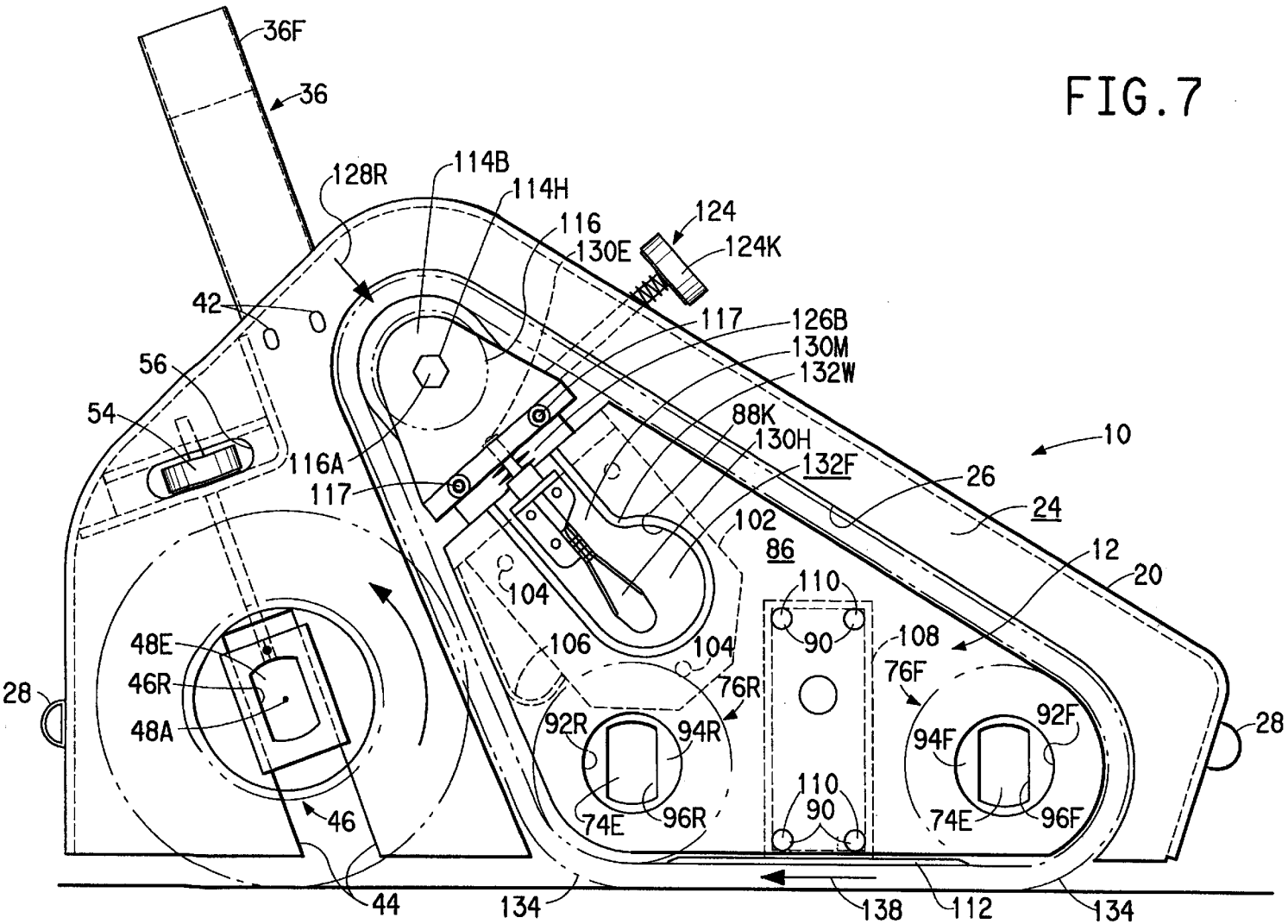
FIG. 7 is a side elevational view of the overall assembly of the apparatus of FIG. 1 taken along view lines 7—7 therein.

The belt module 12 includes a truncated, generally triangular side plate 86 (FIGS. 1 and 7). The side plate 86 is sized and shaped to correspond generally to the size and shape of the cutout 26 in the sidewall 24. The truncated upper apex of the side plate 86 is interrupted by the mouth of a keyhole-like shaped slot 88K, identical in shape to the lower slot portion 62K in the sidewall 22. The side plate 86 also has an array of bolt openings 90 which align coaxially with the bolt openings 66 in the sidewall 22. The side plate 86 has a forward and rearward bores 92F, 92R therethrough. These bores 92F, 92R coaxially align with the bores 68F, 68R in the sidewall 22. The bores 92F, 92R accept sleeves 94 (similar to the sleeves 70). Each sleeve 94 has an axle opening 96F, 96R, respectively, that corresponds in shape to the shape of the axles 74E that project from the forward and a rearward belt support roller 76F, 76R, respectively. The exterior surface of the side plate 86 has a trunnion 80B (FIG. 1) that aligns coaxially with the trunnion 80A on the exterior surface of the sidewall 22. The trunnions 80A, 80B extend into apertures at the lower end of a handle (not shown).

Figure 4:
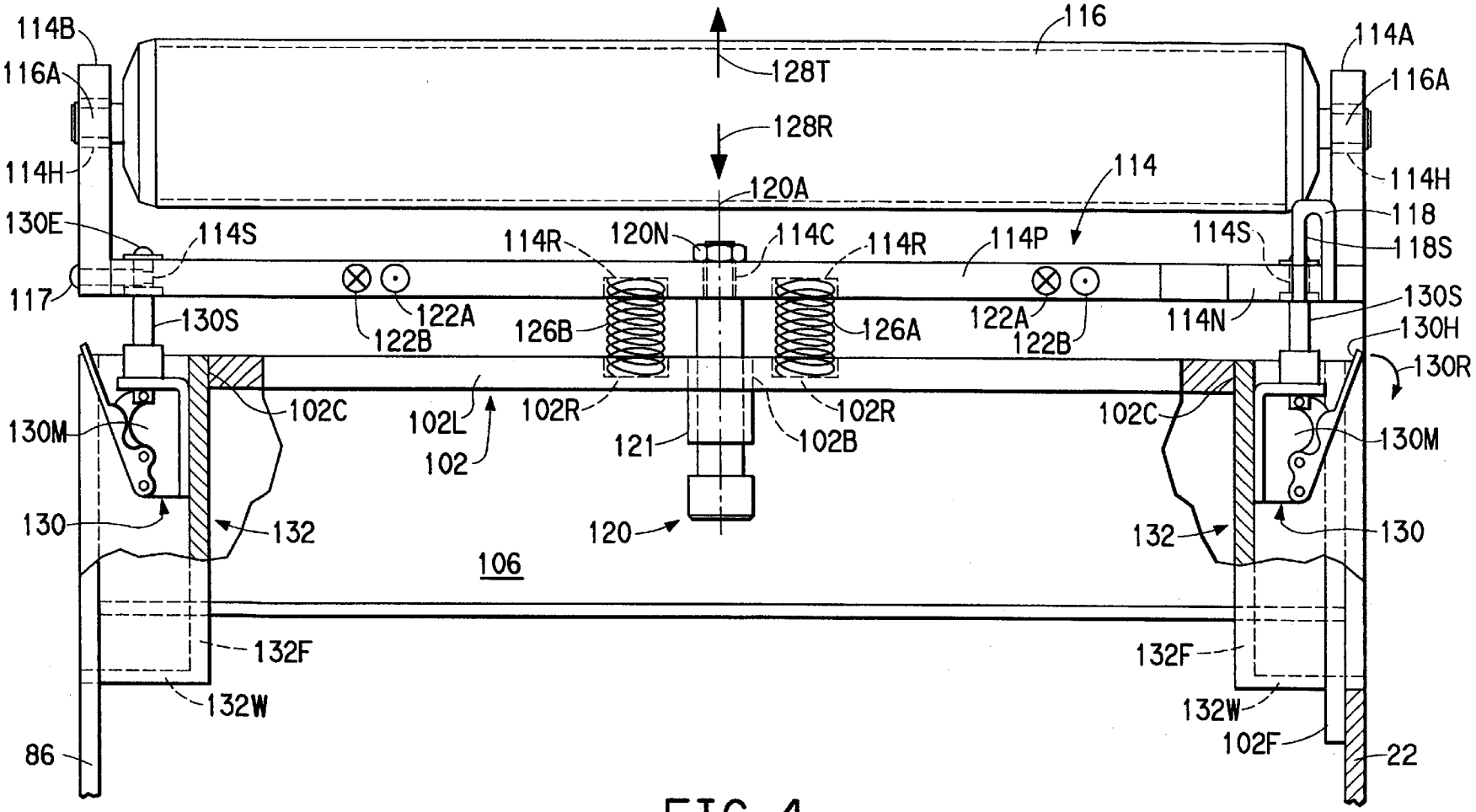
FIG. 4 is a top view taken along view lines 4—4 of FIG. 1 illustrating the mounting of the idler roller for the belt agitator in the apparatus of the present invention.

The belt module 12 further includes a generally L-shaped mounting bracket 102 (FIGS. 1 and 4). Each end of the long leg 102L of the bracket has a cutout 102C therein. A bore 102B is provided centrally along the long leg 102L of the bracket 102. The upper surface of the long leg 102L has recesses 102R therein (FIG. 4). One end of the long leg 102L of the mounting bracket 102 is affixed, as by welding, along the inside surface of the truncated upper edge of the side plate 86. The shorter leg of the mounting bracket 102 defines a flange 102F. When the module 12 is attached within the housing 16 the flange 102F is secured to the inside surface of the sidewall 22 using bolts 104 (FIG. 4) that extend through the bolt holes 64 in the sidewall 22. The flange 102F has a keyhole-shaped slot 102K formed therein. With the flange 102F is bolted to the sidewall 22 the slot 102K registers with the slot 62K. The rearward edge of the mounting bracket 102 has a planar stiffener 106 depending therefrom. The stiffener 106 serves to stiffen the attachment between the side plate 86 and the sidewall 22. In addition, the stiffener 106 serves as a backing for cleaning the surface of the belt agitator 134, as will be described.

The inside surface of the side plate 86 has a generally rectangular beam 108 attached thereto, as by bolts 110 extending through the bolt holes 90. When the module 12 is attached within the housing 12 the other end of the beam 108 is bolted to the sidewall 22 using bolts (not shown) that extend through the bolt holes 66. The undersurface of the beam 108 has a belt support platen 112 (FIG. 6) welded thereto. The platen 112 is sized to span substantially the entire distance between the forward and rear rollers 76F, 76R.

The axle 74E at one end of each of the belt support rollers 76F, 76R is received within one of the axle-receiving openings 96F, 96R in the sleeves 94 in the side plate 86. When the belt module 12 is assembled into the apparatus 10 the axle 74E at the opposite end of the rollers 74F, 74R is received in the corresponding aligned openings 72F, 72R in the sleeves 70 in the sidewall 22.

In accordance with the implementation of the present invention for a manual-operated apparatus illustrated in FIGS. 1 through 7, it is preferred that the motive source for at least one, but preferably both, of the rollers 76F, 76R, as well as for the brush roller 48, be physically housed on the interior of the roller itself. This implementation may be realized by using an internally driven roller such as a 3.15 inch Powerroll® roller manufactured and sold by Interroll Corporation, Wilmington, N.C. The casing that forms the outer surface of such a driven roller is journaled on bearings for relative rotation with respect to the central axle assembly of the roller. The casing of the roller is attached by a planetary gear arrangement to the rotatable part of an electric motor. The stator of the motor is attached to the fixed end of the axle assembly. In this way, both ends of the axle are stationary and may be mounted into the sidewall 22 or side plate 86, as the case may be, while the roller is still able to be rotated. Current for the motor is supplied via electrical leads (not shown) that pass axially outward through one end of the axle assembly. The leads may conveniently be run through the interior of the operator handle (not shown) of the apparatus 10 to switches on a control pad (not shown) mounted on the handle. It should be understood that any convenient alternate motive source for driving the support rollers 76 and the brush roller 48 may be used.

Figure 5:
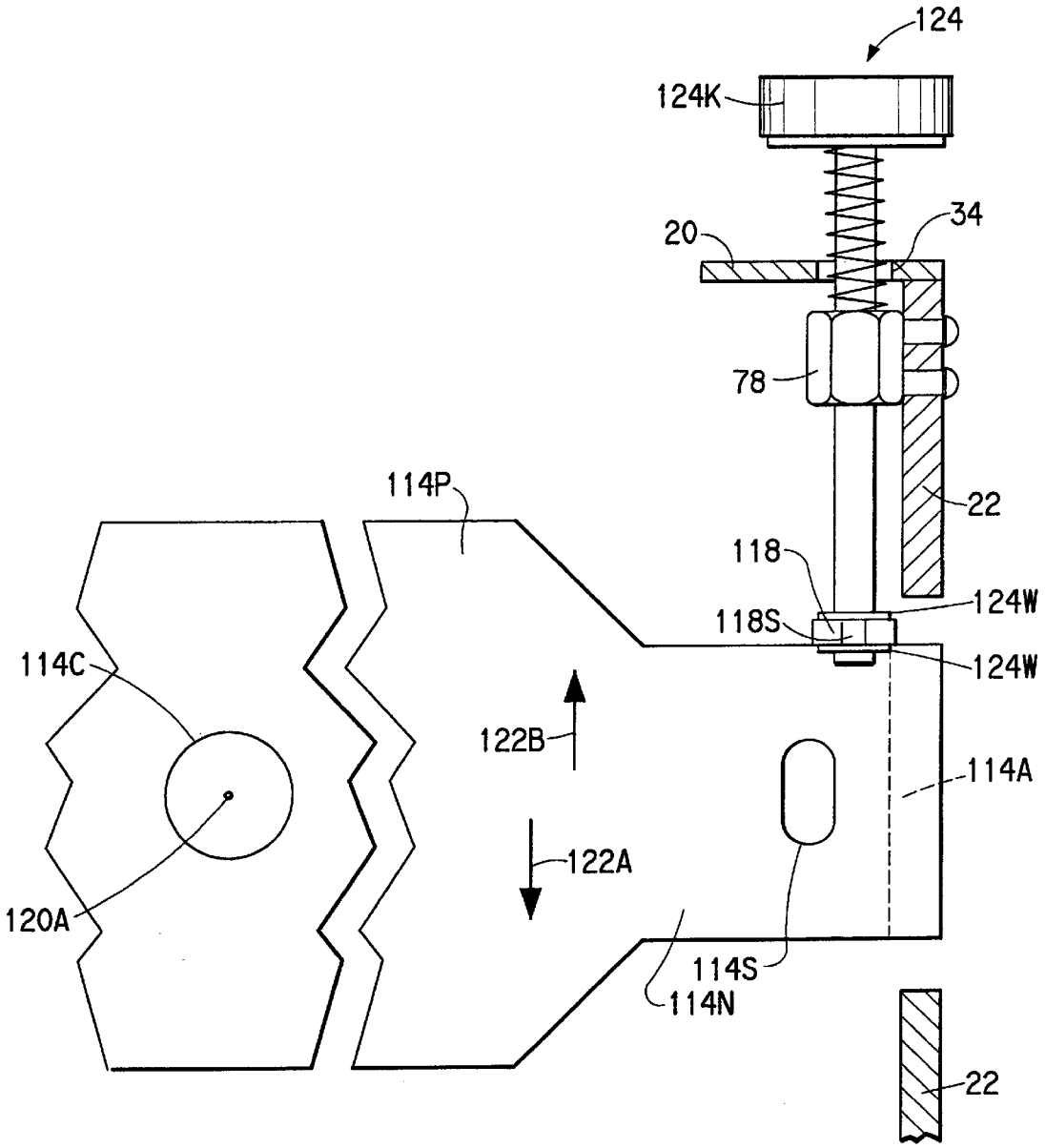
FIG. 5 is an elevational view taken along view line 5 of FIG. 1 illustrating the steering arrangement for the belt agitator in the apparatus of the present invention.

A support yoke assembly 114 (FIGS. 1 and 4) for an idler roller 116 is formed from a baseplate 114P and a pair of upstanding arms 114A, 114B. The arms 114A is secured, as by welding, to the baseplate 114P. However, the arm 114B is removably attached, as by bolts 117 (FIGS. 1 and 5), to facilitate mounting of the roller 116 to the yoke 114. The baseplate 114P is a substantially rectangular member that has a narrower portion 114N (FIG. 5) at the end thereof adjacent to the arm 114A. The baseplate 114P has a bore 114C disposed substantially centrally therealong and an elongated slot 114S near each lateral end. The undersurface of a the baseplate 114P has recesses 114R therein (FIG. 5). The arm 114A corresponds in shape to the rounded oblong portion 62L of the slot 62. The other arm 114B is generally triangular in shape to correspond to the shape of the uppermost portion of the cutout 26 in the sidewall 24. The arms 114A, 114B each have a hexagonal-shaped opening 114H therein (FIG. 4). The openings 114H each receive the stub of an axle 116A that projects from each end of the support roller 116. A suitable support roller is manufactured and sold by Interol Corporation, Wilmington, N.C. as part 1.775.R81.M71. A thin-walled plate 118 (best seen in FIGS. 4 and 5) is mounted to the arm 114A and to the front edge of the backplate 114P in the vicinity of their intersection. The plate 118 has a tracking slot 118S therein.

The yoke assembly 114 is mounted for rotational movement with respect to the axis of an elongated shoulder bolt 120. The bolt 120 passes through a bushing 121 that is press fit into the bore 102B in the bracket 102. The free end of the bolt 120 passes through the central bore 114C of the backplate 114P. The bolt 120 is secured to the backplate 114P by a nut 120N. To control the tracking of the belt agitator 134 the yoke assembly 114 may be rotated about the bolt 120 in the direction of the arrows 122A, 122B (FIG. 5) using a threaded tracking screw 124. As is best seen in FIG. 5 the tracking screw 124 is inserted through the access opening 34 in the cover 20 and passes in threaded engagement with the tracking nut 78 on the sidewall 22. The inside free end of the tracking screw 124 has a pair of spaced washers 124W thereon. The portion of the tracking screw 124 between the washers 124W is received in the slot 118S in the plate 118. Manipulation of a knurled wheel 124K accessible from the exterior of the cover 20 advances or retracts the tracking screw 124 with respect to the nut 78, causing the yoke assembly 114 to rotate in the directions 122A, 122B, respectively, with respect to the axis 120A of the shoulder bolt 120. This rotational adjustment of the yoke assembly 114 maintains the belt agitator 134 alignment on the idler roller 116.

A pair of springs 126A, 126B extends between the backplate 114P of the yoke assembly 114 and the mounting bracket 102. The ends of the springs 126A, 126B are captured in the recesses 102R, 114R in the long leg 102L of the bracket 102 and in the baseplate 114P of the yoke 114, respectively. The springs 126A, 126B form a tensioning arrangement that urges the yoke assembly 114 outwardly (i. e., away from the support rollers 76F, 76R) in the direction 128T. The motion of the yoke assembly 114 is guided by the shoulder bolt 120 and the bushing 121. The extension of the yoke assembly 114 to the extended position is illustrated in FIG. 1 serves to tension the belt agitator 134 against the support rollers 76F, 76R and the idler roller 116.

The yoke assembly 114 is retractable toward the mounting bracket 102 in a direction 128R (opposed to the tensioning direction 128T) by a pair of toggle bolt assemblies 130. Each toggle bolt assembly 130 includes a shaft 130S that extends from an actuating mechanism 130M. The actuating mechanism is operable using a handle 130H. The shaft 130S has an enlarged head 130E. The head end of the shaft 130S of each of the toggle bolts 130 passes through a respective one of the elongated slots 114S in the backplate 114P such that the head 130E overlies the surface of the backplate 114P of the yoke. The actuating mechanism 130M of each toggle bolt assembly 130 is secured within the recess provided by a respective open-faced receptacles 132.

Each receptacle 132 is formed of an upstanding wall 132W attached to a planar floor 132F. Each receptacle 132 has a shape that generally corresponds to the distinctive keyhole shape of the slots 62K, 88K or 102K. One of the receptacles 132 is attached on the inside surface of the side plate 86 with the wall 132W of the receptacle 132 extending through the slot 88K so that the edge of the wall 132W lies flush with the exterior surface of the side plate 86. Similarly, the other receptacle 132 is attached on the inside surface of the flange 102F. In this case the wall 132W of the receptacle 132 extends through the registered keyhole-shaped slots 102K, 62K in the flange 102F and the sidewall 22, respectively. The edge of the wall 132W of this receptacle 132 lies flush with the exterior surface of the sidewall 22. The cutouts 102C are provided in the bracket 102 to receive the receptacles 132 therein.

To move the yoke assembly 114 to the retracted position shown in FIGS. 6 and 7 the shaft 130S of each toggle bolt 130 is drawn in the direction 128R by manipulation of the handle 130H in the direction 130R This action brings the undersurface of the head 130E against the backplate 114P of the yoke 114 to retract the yoke 114 toward the mounting bracket 102 against the bias of the springs 126, thereby relieving tension on the belt agitator 134. The open receptacles 132 are advantageous in that they allow access to the toggle mechanism whereby the yoke may be extended or retracted, while at the same time the recess afforded by the interior volume of the receptacle permits the toggle bolt to lie within the confines of the apparatus 10 and not interfere with the movement of the cleaning apparatus into close proximity of the walls of an area in which a carpet is being cleaned.

As suggested in FIG. 6, the belt agitator 134 is an endless web comprised of a substrate 134F, such as a woven synthetic fabric, having pile fibers 134P tufted thereinto. The inside surface of the substrate 134F may be coated with a suitable coating (e. g., latex) to prevent the tufts 134P from separating from the fabric 134F and also to provide sufficient friction at the interface between the belt 134 and the support rollers 76 driving the same. A belt agitator 134 in the most preferred form has an appearance and feel that is similar in appearance and feel to the surface fabric used on a paint roller. As an example, material suitable for use as the belt agitator 134 may be obtained from Monterey Mills Inc., Jamesville Wis., under style number 675-159. To form the endless web the ends of the fabric are joined together, preferably using a heat sealable fabric. In some instance it may be desirable to tuft stiffer monofilament fibers into the fabric substrate 134F to enhance the agitating action of the belt 134. The softer pile fibers tufted into the fabric serve to carry cleaning liquid to the carpet, while the stiffer monofilament fibers tufted into the substrate serve to scrub the carpet.

The belt 134 passes under the platen 112 and is trained over the support rollers 76F, 76R and the idler roll 116. When the toggle bolts 130 occupy the extended position (FIG. 1) the belt 134 is urged tautly against the rollers 76F, 76R, 116 and the platen 112 by the action of the tensioning springs 126. To remove the belt 134 for replacement, the toggle bolts 130 and the yoke assembly are retracted (FIG. 6) and the spent belt 134 is slid axially from the rollers 76F, 76R, 116 and the platen 112. A replacement belt 134 may then be slid axially onto these members, and the toggles and the yoke assembly extended. An endless belt agitator 134 trained over the rollers 76F, 767R, 116 and under the platen 112 is preferred in accordance with this invention because such an arrangement is seen to improve the scrubbing action on the carpet over that believed attainable using a rotating brush or an applicator pad. The structural arrangement disclosed herein enlarges the agitating surface area interface between the belt agitator 134 and the surface of the carpet. In addition, the fabric/pile structure of the belt agitator is believed to provide an increased volumetric capacity for carrying soil and cleaning agent away from the carpet surface.

To assemble the apparatus 10, the belt module 12 is assembled from the side plate 86 with the bracket 102 and the beam 108 attached thereto, and with the axles 74 at one end of the rollers 76F, 76R inserted into the sleeves 94. The module so assembled is inserted into the interior volume 14 of the housing 16 through the opening afforded by the cutout 26 in the sidewall 24. The module 12 is advanced until the flange 102F (at the distal end of the bracket 102), the distal end of the beam 108, and the distal axles 74 on the rollers 76F, 76F are abutted against the inside surface of the sidewall 22. The flange 102F, the beam 108 and axles 74 of the rollers 76F, 76R are then attached in the manner described above thereby to interconnect the belt module 12 into the apparatus 10. The tracking screw 124 is manipulated in the opening 34 from the exterior of the housing 16 to insure that the end of the screw 124 is engaged into the slot 118S in the plate 118. Once the module 12 is secured within the housing 16, a handle bar is connected to the trunnions 80A, 80B that project laterally from the sidewall 22 and the side plate 86, respectively.

To operate the apparatus 10 actuation of the motor internal to at least one of the support rollers 76 causes the belt agitator 134 to rectilinearly displace in the direction of the arrow 138 (FIGS. 6 and 7) thereby to bring a portion of the belt agitator 134 (e. g., the axially extending strip portion 140S) sequentially from a position within the housing 16, to an agitating position in which the portion of the belt agitator 134 is in contact with a carpet and, thereafter, to return the portion of the belt agitator 134 to the housing 16. Each incremental axially extending strip 140S of the belt agitator 134 thus moves from a position that is within the housing 16 (such as the position 140A), to a position (such as the position 140B) in which the given axial strip 140S of the belt agitator 134 is contacted against the carpet, to a position (such as the position 140C) in which the given axial strip 140S of the belt agitator 134 is returned to the interior of the housing 16. Each incremental axial strip of the belt agitator 134 passes in a rectilinear direction over the surface of the carpet. Thus, in accordance with this embodiment of the invention, an agitating apparatus 10 is provided that is adapted to agitate a cleaning agent into a carpet without imparting any rotational motion to the pile of the carpet. The motor internal to the pile lifting roller 48 drives that roller and the brush 50 thereon in a direction 142 counter to the direction 138 of rectilinear motion of the belt agitator 134 to counteract the drag of the belt on the carpet. In use, the apparatus 10 is advanced and retracted (in a "W-shaped" pattern) across a carpet surface by an operator.

In the preferred implementation of the present invention the suction shroud 36 is positioned within the housing 16 to lie a predetermined close distance to the pile surface of the belt agitator 134 when the same has been returned into the interior of the housing 12 (i. e., to the position 140C). Locating the shroud 36 proximally to the belt 134 after it has returned to the interior of the housing 16 utilizes the suction to clean the surface of the belt agitator 134 to remove any dirt or other matter that has become lodged therein while the agitator 134 passed over the carpet. In a more preferred implementation the cleaning action of the suction is further enhanced if the forward lip 36F of the shroud 36 is positioned to contact against the pile surface of the belt agitator 134.

As seen in FIG. 6 it is also within the contemplation of the present invention to utilize the bristles 50B of the pile lifting brush 50 to engage against the pile surface of the belt agitator 134 upstream of the location at which the suction shroud 36 is disposed. It is recalled that the pile lifting roller rotates in a direction 142 opposite to the direction 138 of motion of the belt agitator 134. However, in the vicinity of their interaction the pile lifting brush 50 and the belt 134 are moving in parallel. Owing to the difference in diameter between the bristle brush 50 and the roller 76R, relative motion occurs between the bristles 50B of the brush 50 and the pile surface of the belt 134. This relative motion (acting against the backing afforded by the stiffener 106) tends to loosen any matter carried on the belt agitator 134 prior to encountering the effect of the suction. The difference in speeds could be alternatively accomplished, as for example, by changing the relative drive speeds of the rollers 48 and 76R.

The trailing lip 36R of the shroud 36 could also be used to serve to flex the bristles 50B of the pile lifting brush 50 to expel particles carried thereon. In the most preferred instance, then, the line of interaction 144F of the forward lip 36F of the shroud 36 and the belt 134, the line of interaction 144R between the trailing lip 36R of the shroud 36 and the bristles 50B of the pile lifting brush 50, together with the line of interaction 144B between the pile lifting brush 50 and the belt 134, cooperate to define a suction zone generally indicated at 146 immediately forward of the mouth 36M of the shroud 36 in which particulate matter thrown from the belt agitator 134 and/or from the pile lifter brush 50 are collected by the suction. The pile lifter brush 50 also serves to groom the carpet surface in a manner known in the art.

Figure 8A:
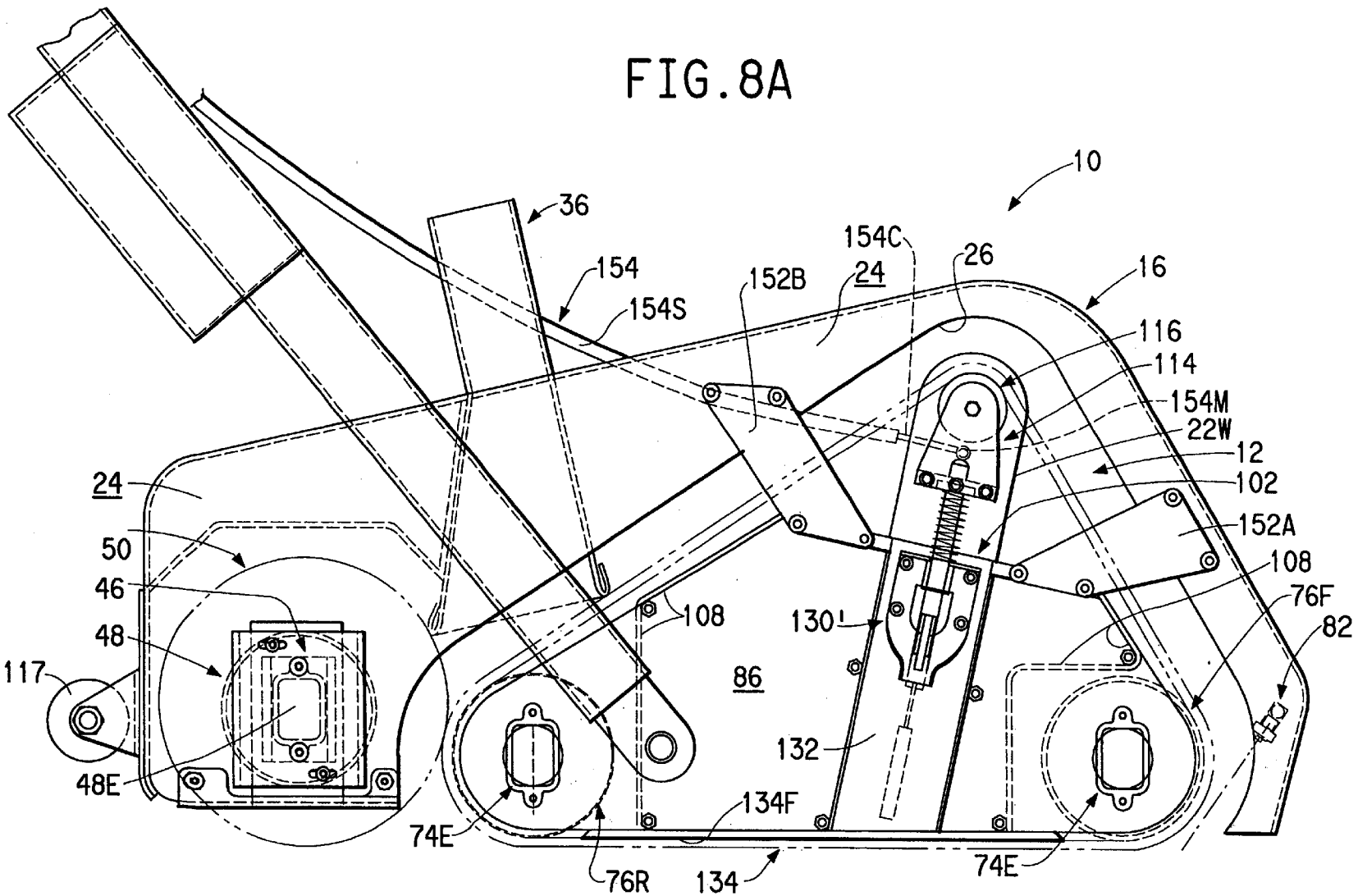
FIG. 8A is a side elevational view, in section (generally similar to FIG. 6), of a modified version of the three roll embodiment of the apparatus of the present invention as shown in FIGS. 1 through 7.
Figure 8B:
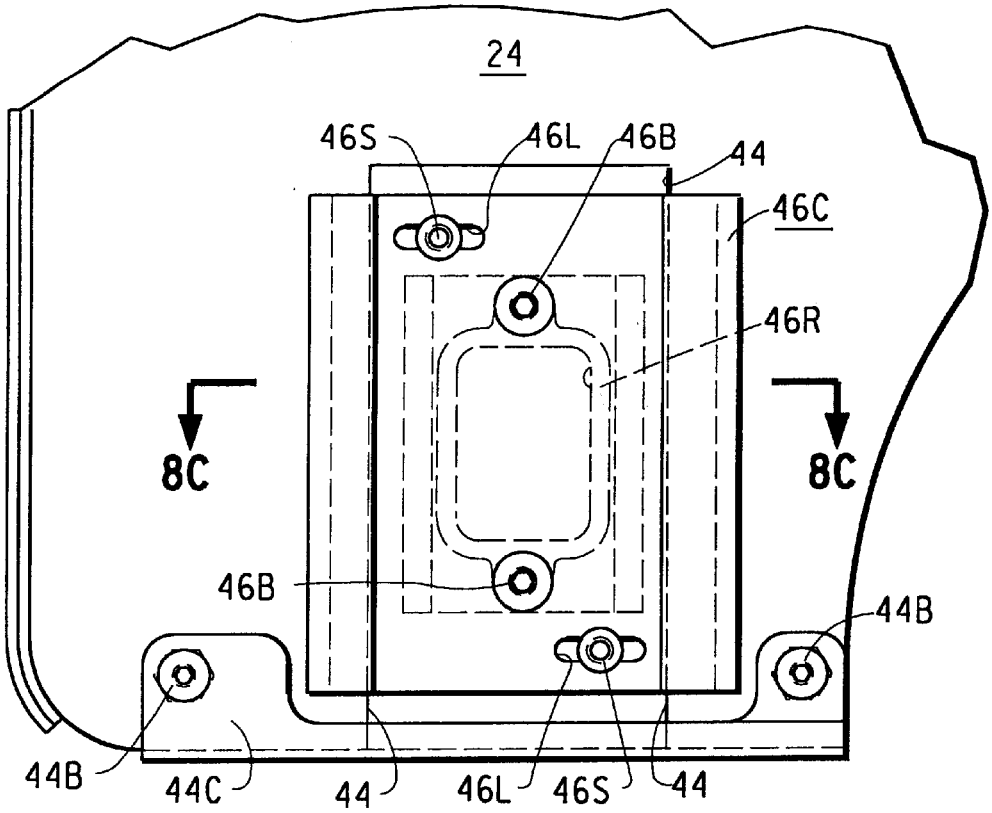
FIG. 8B is an enlarged side elevational view of a portion of FIG. 8A
Figure 8C:
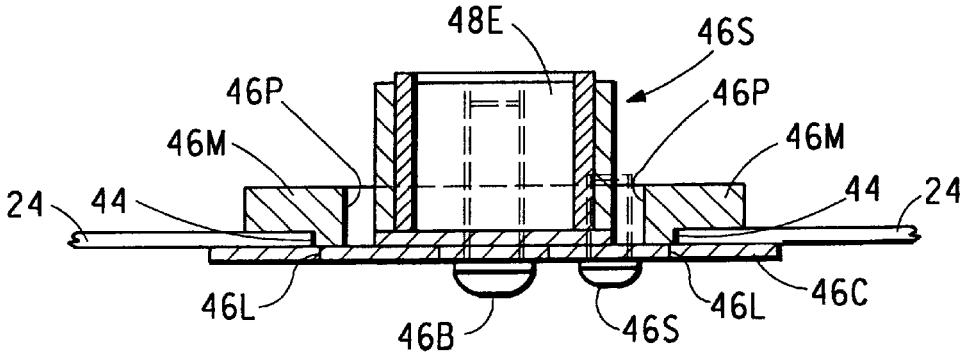
FIG. 8C is a sectional view taken along appropriate section lines 8C—8C, both illustrating a modified arrangement for positioning the bristle brush in accordance with this modified version of the invention.

FIGS. 8A through 8C illustrate a modified version of the three roll embodiment of the invention as heretofore described and illustrated in connection with FIGS. 1 through 7. The overall thrust of the modifications shown in these FIGS. 5A to 8C is to impart a more robust configuration to the apparatus and to impart more powerful agitating and cleaning action.

Increased cleaning action may obtained through the use of faster and more powerful internally driven roller for the brush roller 48 and for the rollers 76F and/or 76R. Internally driven rollers of the type described earlier and sold by Interroll Corporation, Wilmington, N.C. as 4.5 inch Powerroll® rollers have been found useful. In addition, slippage between the inside surface of the substrate 134F and the surface of the rolls may be minimized by the use of high friction tape as a wrapping over the surface of the roller(s). Suitable for use as the tape wrap is the high friction tape sold by 3M Corporation, Minneapolis, Minn. as product 5461.

With an increased frictional interface between the rollers and the substrate 134F of the belt 134 it may be required to provide toggles bolts 130' having a longer action stroke. To afford the space necessary for a longer stroke, while at the same time not unduly increasing the height of apparatus, it is desirable to relocate the idler roller 116 and the associated mounting bracket 102 and support yoke assembly 114 more forwardly within the housing 16. The forward relocation of the idler roller 116 with respect to the rollers 76F, 76R is illustrated in FIG. 8A. As a consequence of this relocation the center of gravity of the modified version of the apparatus 10 has been shifted more forwardly. This rearrangement of parts thus serves to counter any tendency for the front of the apparatus to tip upwardly. A transport roller 117 is mounted to the housing 16 to facilitate moving of the apparatus.

With the idler roller 116 and its associated support structures moved forwardly the receptacles 132 may be sized to accept toggle bolt assemblies 130' having a sufficient action stroke to retract the yoke assembly 114 and to permit the belt 134 to be expeditiously removed from the surface of the rollers 76F, 76R and 116 despite the presence of a high friction wrap.

Other of the structural modifications illustrated in FIGS. 8A through 8C add to the robustness of the apparatus. For example, the cross section of the beam 108 has been increased, enhancing the overall stiffness of the apparatus. To avoid any proclivity for the cantelivered side plate 86 of the belt module 12 to hang downwardly from the housing 16 as the apparatus is handled, a pair of external tie plates 152A, 152B have been disposed between the sidewall 24 and the side plate 86 to interconnect these members.

The back arm 114A of the yoke 114 (not visible in FIG. 8A) is accessible through a window 22W in the back side plate 22. The tracking screw 124 and associated tracking plate 118 (FIG. 5) have been replaced by a cable assembly 154 that includes a push-pull cable 154C affixed by a mounting clip 154M to the exterior of the arm 114A of the yoke 114. The cable 154C is conveyed through a sheath 154S and is accessible at the handle of the apparatus to an operator. Since motions imparted to the apparatus during cleaning of a carpet may result in the belt "walking off" the lateral ends of the roller 116, relocating the tracking control to the handle permits an operator to maintain tracking control while operating the apparatus.

As is best seen in FIGS. 8B and 8C the modified apparatus also includes an arrangement whereby the brush roller 50 may be moved both vertically and horizontally. In the modified version the slots 44 in the rearward margins of the sidewalls 22, 24 are oriented substantially vertically, instead of being inclined to vertical as illustrated in FIGS. 1 and 7. The mounting block 46 is implemented as a two-piece structure comprised of an inner, major portion 46M and a cover 46C. The axle-receiving opening 46R is formed in a tubular shock mount 46T that is attached by bolts 46B to the cover 46C. (Similar shock mounts are used for the rollers 76F, 76R.) A wider clearance passage 46P is formed in the major portion 46M. When joined the members 46M, 46C cooperate to define the paired arms that hold the block 46 to the surfaces of the sidewalls defining the slots 44. In addition, the cover 46C is provided with a pair of adjustment channels 46L that accept screws 46S that hold the cover 46C to the major portion 46M. The lower end of the slot 44 is closed by a channel 44C bolted to the sidewall by bolts 44B.

In the modification illustrated the thumbwheel 54 (FIGS. 3A, 3B) is omitted, and the block 46 is free to float vertically within the slots 44, thereby to adjust vertically the axis of the brush roller 50. Horizontal adjustment of the position of the roller 50 is afforded by loosening the mounting screws 46S, adjusting the lateral position of the cover 46C with respect to the major portion 46M of the block 46, and re-tightening the screws. Horizontal adjustment of the location of the roller 50 accommodates thickness variations in the belt 134.

The modified apparatus shown in FIGS. 8A through 8C operates in the manner as earlier described.

Figure 9:
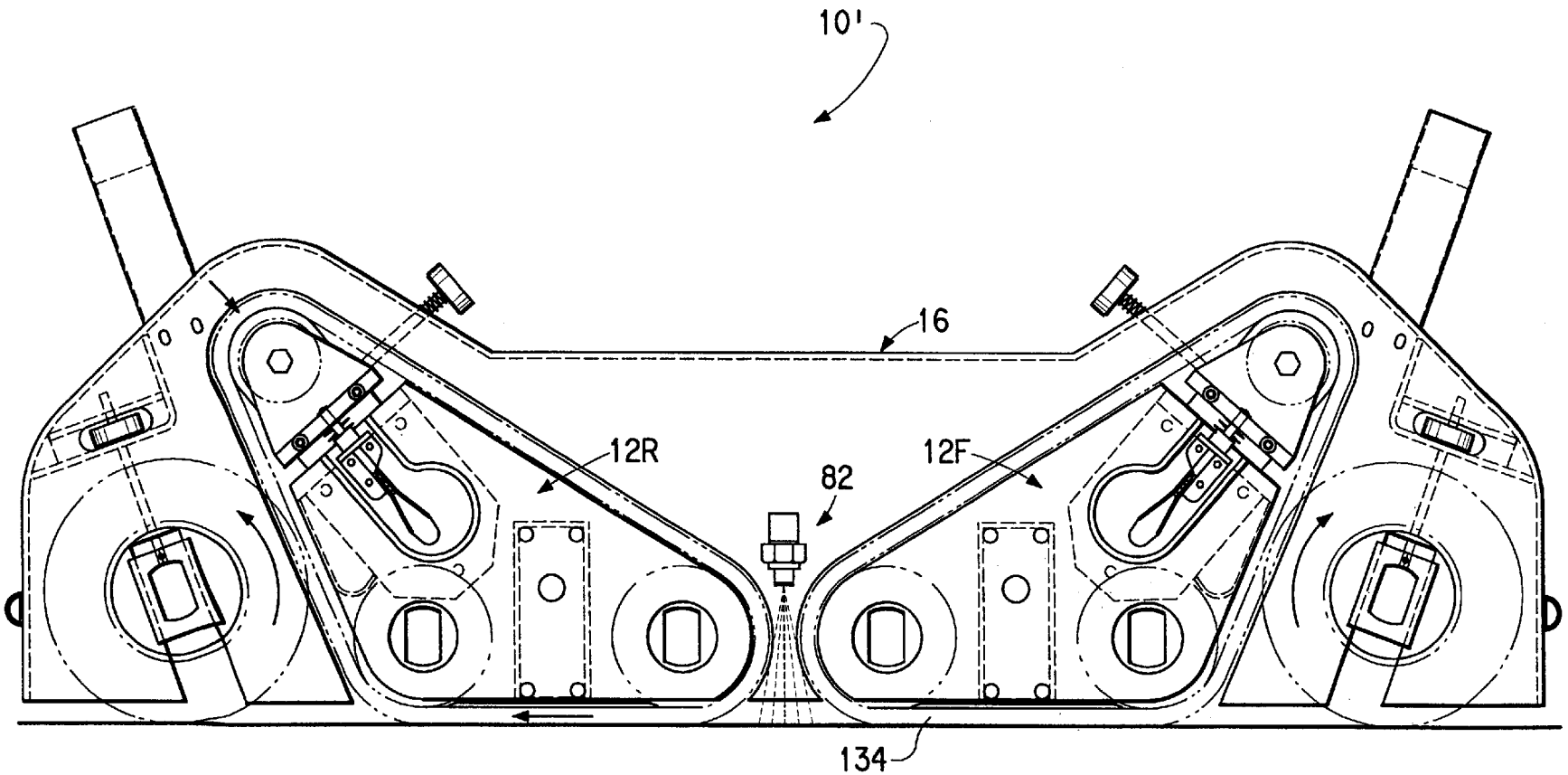
FIG. 9 is a side elevational view partially in section of an alternate embodiment of the apparatus of the present invention.

An apparatus in accordance with the present invention may also be configured into a larger, self-propelled configuration 10', as shown in the side elevational, sectional view of FIG. 9. In this embodiment of the invention a pair of belt modules 12F, 12R, each configured as described earlier, is disposed in confrontational relationship with respect to each other. The belt modules 12F, 12R are arranged such that the belt agitators 134 thereof rectilinearly displace in opposed directions. In this way the drag of one belt agitator is counteracted by the action of the other belt agitator, permitting the apparatus to be advanced along the surface by the operator. The dispenser bar 82 in this embodiment is located centrally of the housing 16, intermediate the belt modules 12F, 12R, permitting the nozzles to deliver a spray of liquid cleaning agent to the surface of both belt agitators and to the surface of the carpet. The housing 16 of the apparatus shown in FIG. 9 may have integrally mounted thereon a liquid or foam cleaning agent reservoir, a spent liquid collection reservoir, and a low pressure suction source.

Figure 10A:
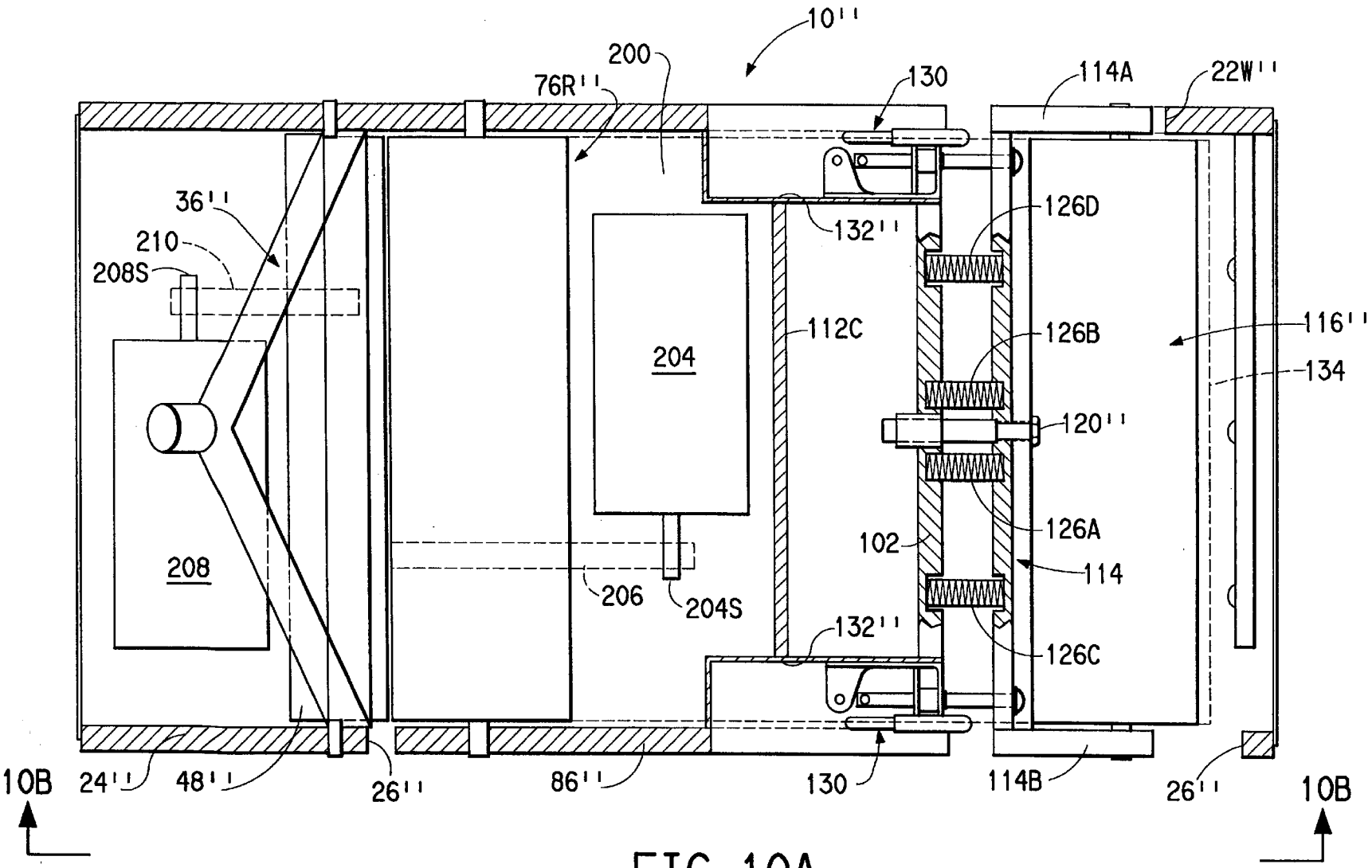
Figure 10B:
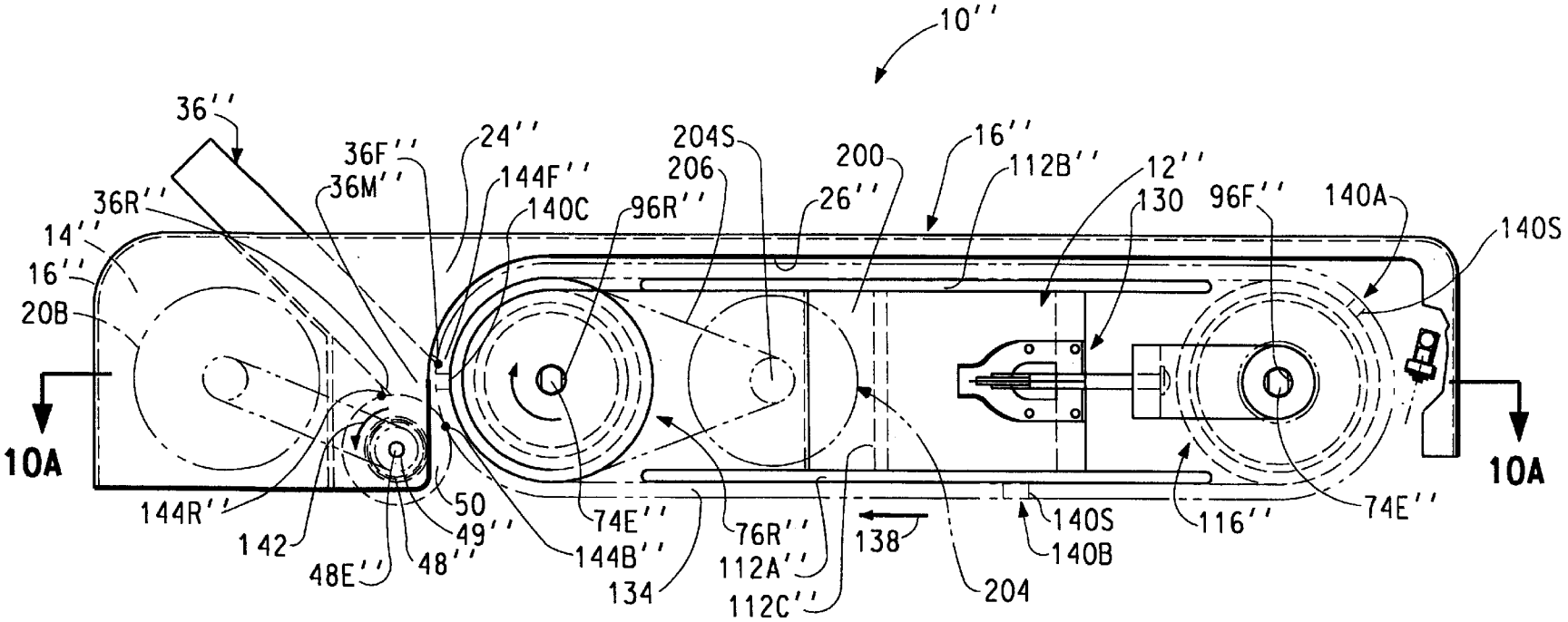
FIG. 10B is a side elevational view taken along section lines 10B—10B in FIG. 10A.

FIGS. 10A and 10B illustrate a second alternate embodiment of the apparatus 10" in accordance with the present invention. In this embodiment the functions of the forward one of the belt support rollers 76F and of the idler roller 116 have been combined, thereby imparting a lower, more compact profile to the apparatus, as shown in the side elevational, sectional view of FIG. 10B. Thus, in accordance with this aspect of the invention, the belt 134 is trained about only a pair of rollers, namely, a modified rear roller 76R" and a forward roller 116".

In keeping with the more compact profile the dome-like portion of the cover member 20 of the housing 16" may eliminated. The top surface of the housing 16" is thus planar in configuration, and is efficiently able to receive thereon the liquid cleaning agent reservoir and pump, a spent liquid collection reservoir, and a low pressure suction source used by the cleaning apparatus 16". The sidewall 24" of the housing 16" exhibits the cutout 26" through which the belt 134 is inserted onto and removable from the rollers disposed in the belt module 12". In this embodiment the sidewall 22" of the housing 16" also has a window 22W" therein.

The structural framework of the belt module 12" is also modified in this embodiment of the invention. The sidewall 86" and the sidewall 22" are interconnected by lower and upper horizontal brace plates 112A", 112B" and by a transversely extending vertical brace plate 112C". Together with the bracket 102, the horizontal brace plates 112A", 112B" and the vertical brace plate 112C" stiffen the structure of the apparatus 10". The horizontal and vertical brace plates cooperate to define an interior chamber 200 within the apparatus 10" for a purpose to be described. The horizontal brace plate 112A" defines the platen that supports the belt 134.

The forward roller 116" is mounted between the arms 114A, 114B of the support yoke assembly 114 that is itself connected via a stud 120" to mounting bracket 102. The side of the arm 114A is accessible through the window 22W" in the sidewall 22" of the housing 16", so that a suitable arrangement for controlling the tracking of the belt to the roll may be attached to the yoke 114. Aside from the provision of a second pair of springs 126C, 126D (to increase belt tension), the yoke 114, the stud 120" and the bracket 102 are substantially identical in structure and operation to the arrangement illustrated and discussed in connection with FIG. 4.

The yoke assembly 114 is retractable against the bias of the springs 126A through 126D by toggle assemblies 130. The toggle assemblies 130, which are similar to those disclosed in FIG. 5, are received in generally rectanguloid receptacles 132" formed in the sidewalls 22", 86". With the forward roller 116" retracted the belt 134 may be laterally removed from the rear roller 76R" and a forward roller 116" through the cutout 26".

The vacuum shroud 36" projects into the interior volume 14" of the housing 16" rearwardly of the rear roller 76R". The transverse edges surrounding the mouth 36M" of the shroud 36" are again folded to provide stiff, transversely extending lips 36F", 36R". The lip 36F" contacts against the material of the belt agitator 134 along a line of action 144F". The rear lip 36R" of the shroud 36" engages with the pile lifting brush 50 along a line of action 144R". The brush 50 is itself mounted to a roller 48" that is supported for rotation within the rear portion of the interior volume 14" of the housing 16". The brush 50 contacts the carpet and contacts the fabric 134 along the line of interaction 144B".

The rollers 48", 76R" and 116" are implemented using internally journaled rollers of the type sold by Interroll Corporation, Wilmington, N.C. as Series 1.940 idler rollers. The surface of the rollers 76R" and 116" should be coated with polyurethane. Accordingly, to mount the rollers 76R" and 116" to the sidewalls 22", 86", it is necessary only to provide suitable sleeves members 96R", 96F" to accept the axles 74E" projecting laterally from each end of such rollers. The sleeves are mounted in openings provide in the sidewalls. Similarly, the axles 48E" projecting from each end of the roller 48" are also received in sleeves 49" which are themselves received in openings in the sidewalls 22", 24". In the embodiment shown in FIGS. 10A, 10B the adjustment blocks 46 are omitted.

Motive force for the roller 76R" is provided by a motor 204 that is received within the interior chamber 200. The motor 200 is supported within the chamber 200 by attachment to the upper horizontal brace plate 112B". The shaft 204S of the motor 204 is connected through a V-belt 206 to the roller 76R". To effect this interconnection the surface of the roller 76R" has a V-groove formed therein. The interconnection between the roller 76R" and the V-belt 206 is under the belt 134.

The brush roller 48" is driven in similar fashion, albeit in the counter direction 142". A second motor 208 is supported by the housing 16". The shaft 208S of the motor 208 is connected to the roller 48" by a v-belt 210 engaged with a corresponding groove formed in the surface of the roll 48". The locations of the motors 204, 208 and their connections to the associated rollers is balanced to keep the weight of the apparatus centered over the platen and fabric belt. Suitable for use as the motors 204, 208 are dc motors available from Stature Electric, Inc., Watertown, N.Y.

The operation of the apparatus 10" is closely similar to the operation of the three-roll embodiment discussed in connection with FIGS. 1 through 7. To briefly recap, rotation of the roller 76R" rectilinearly displaces the belt 134 the direction of the arrow 138 and brings an axially extending strip portion 140S of the belt 134 sequentially from the positions 140A (within the housing 16"), to agitating position 140B (in which the portion of the belt agitator 134 is in contact with a carpet) and thence to position 140C (within the housing 16"). The vacuum shroud is positioned so as to communicate with the interior of the housing 16" (in the region of the position 140C) to suction the surface of the belt agitator 134 to remove any dirt or other matter that has become lodged therein while the agitator 134 passed over the carpet. Particles thrown into the suction zone 146 defined by the line of interaction 144F (between the forward lip 36F of the shroud 36 against the pile surface of the belt agitator 134), the line of interaction (trailing lip 36R of the shroud 36 also flexes the bristles 50B of the pile lifting brush 50), and the line of interaction 144B (between the pile lifting brush 50 and the belt 134) are removed by the suction.

-o-0-o-

In each of the embodiments of the invention as hereinbefore described the belt 134 is trained over at least one drive roller (e. g., in FIGS. 6, 8A, either the roller 76R or 76F, or in FIG. 10B, the roller 76R") and an idler roller 116 (or 116", FIG. 10B) and is tautly held against the platen 112/112A". Thus, as the belt 134 is rectilinearly displaced beneath the platen 112/112A" successive strips 140S of the belt 134 are brought into agitating contact with the carpet. It may be appreciated that, taken together, the collection of the strips 140S of the belt 134 that are at any instant in agitating contact with the carpet define an agitating surface area that generally corresponds to the area of the platen 112/112A". The agitating action generated by the rectilinear motion 138 of the belt 134 beneath the platen 112/112A" works the liquid or foam cleaning agent dispensed from the dispenser bar 82 into the carpet.

It is believed that the agitating action of the rectilinearly moving belt 134 may be enhanced if an additional vibratory motion is imparted thereto. To achieve this additional vibratory motion of the belt 134 the three-roll embodiments of the apparatus 10 (shown in FIGS. 1–8C) or the two-roll embodiment of the apparatus 10" (shown in FIGS. 10A, 10B) may be structurally modified as shown in FIGS. 11A through 11D.

Figure 11A:
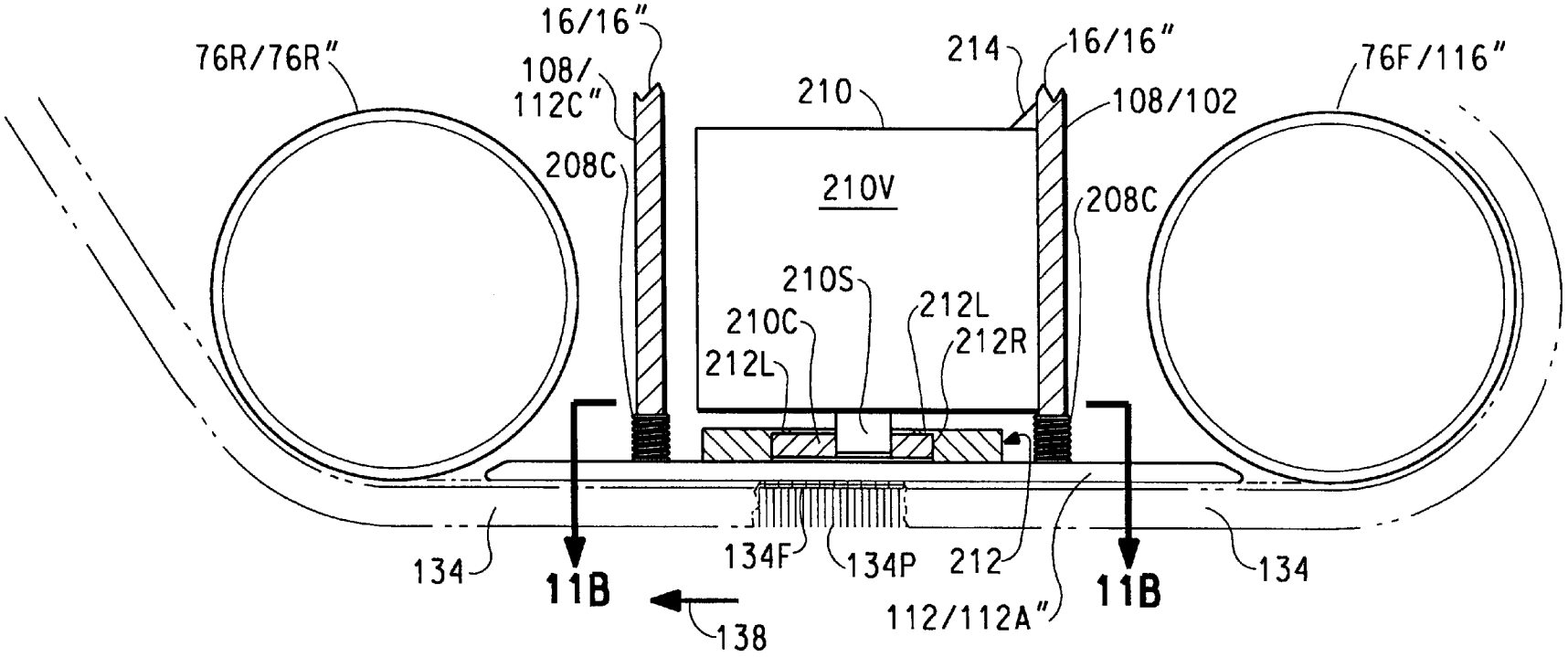
Figure 11B:
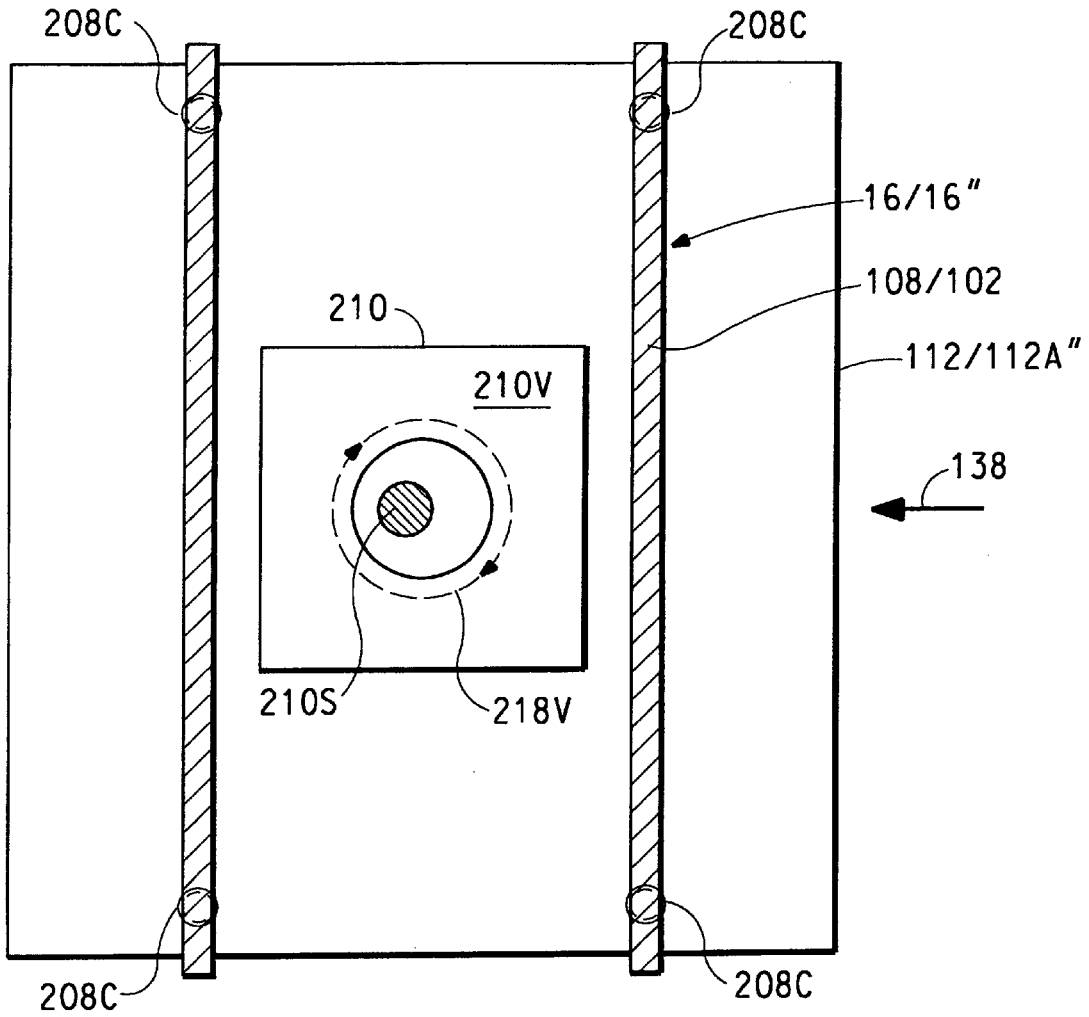
FIG. 11B is a top sectional view taken along section lines 11B—11B in FIG. 11A.

FIGS. 11A and 11B are respective enlarged side elevational and plan views of one embodiment of the modified apparatus. The view of FIG. 11A is meant to depict the situation shown in FIGS. 6, 8A (illustrating the mounting of the platen 112 within the apparatus 10) and shown in FIG. 10A (illustrating the mounting of the platen 112A" within the apparatus 10"). In each of these earlier Figures the member defining the platen 112/112A" extends between a pair of rollers. In the embodiment of FIGS. 6, 8A the roller forward of the platen 112 is the roller 76F, while the roller to the rear of the platen 112 is the roller 76R. In the two-roll arrangement of FIG. 10A, 10B the idler roller 116" is forward of the platen 112A" while the roller 76R" is located to the rear thereof. In all instances of the earlier views the platen 112 or 112A", as the case may be, is rigidly mounted, as by welding, to the structural framework of the housing 16 or 16".

In accordance with the modification of the invention shown in FIG. 11A the platen 112/112A" is mounted so as to be movable in its own plane with respect to the housing 16/16". Suitable support members are required both to restrain the motion of the platen 112/112A" and to support the weight of the entire cleaning apparatus 10/10". In the embodiment of FIG. 11A the support members take the form of coil springs 208C which are provided between the platen 112/112A" and the structural framework of the housing 16/16". The coil springs 208C perform both the restraint and support functions. Flexible rubber posts could alternatively be used to provide both the support and the restraint functions.

Figure 11C:
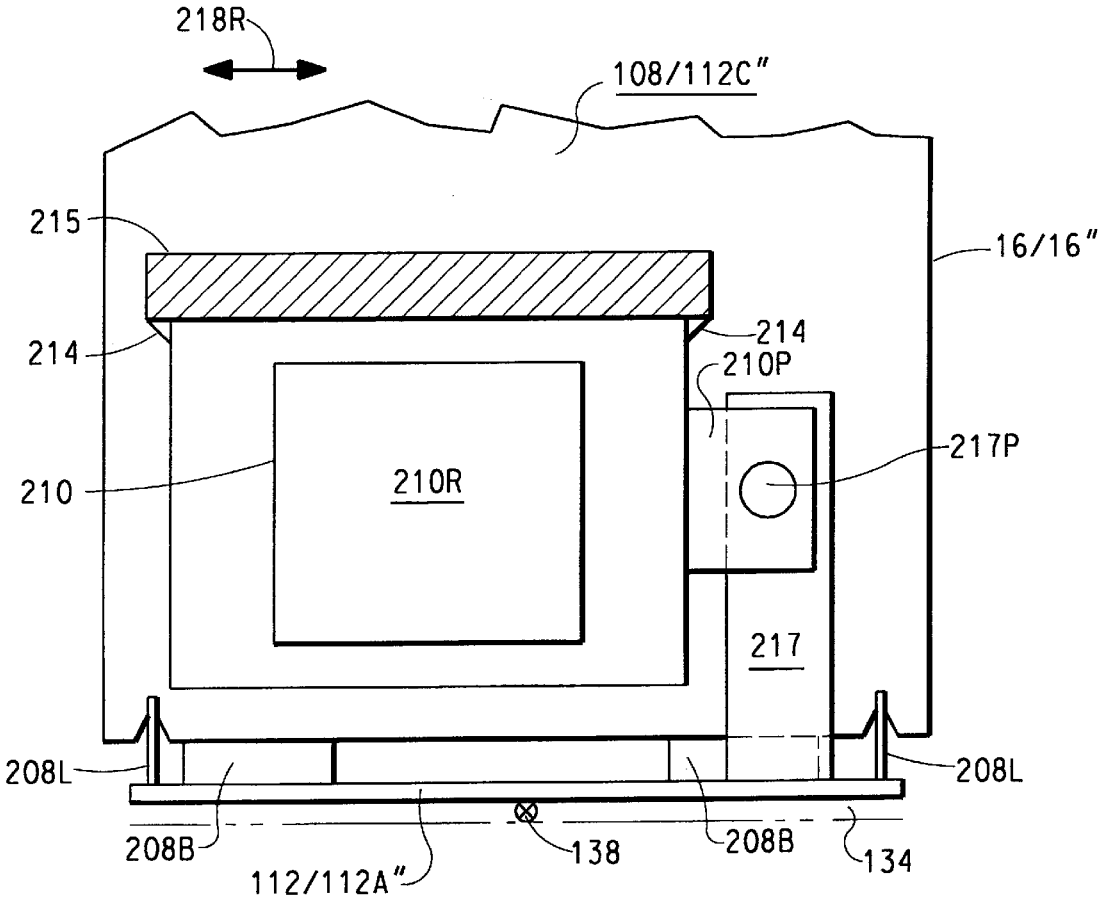
Figure 11D:
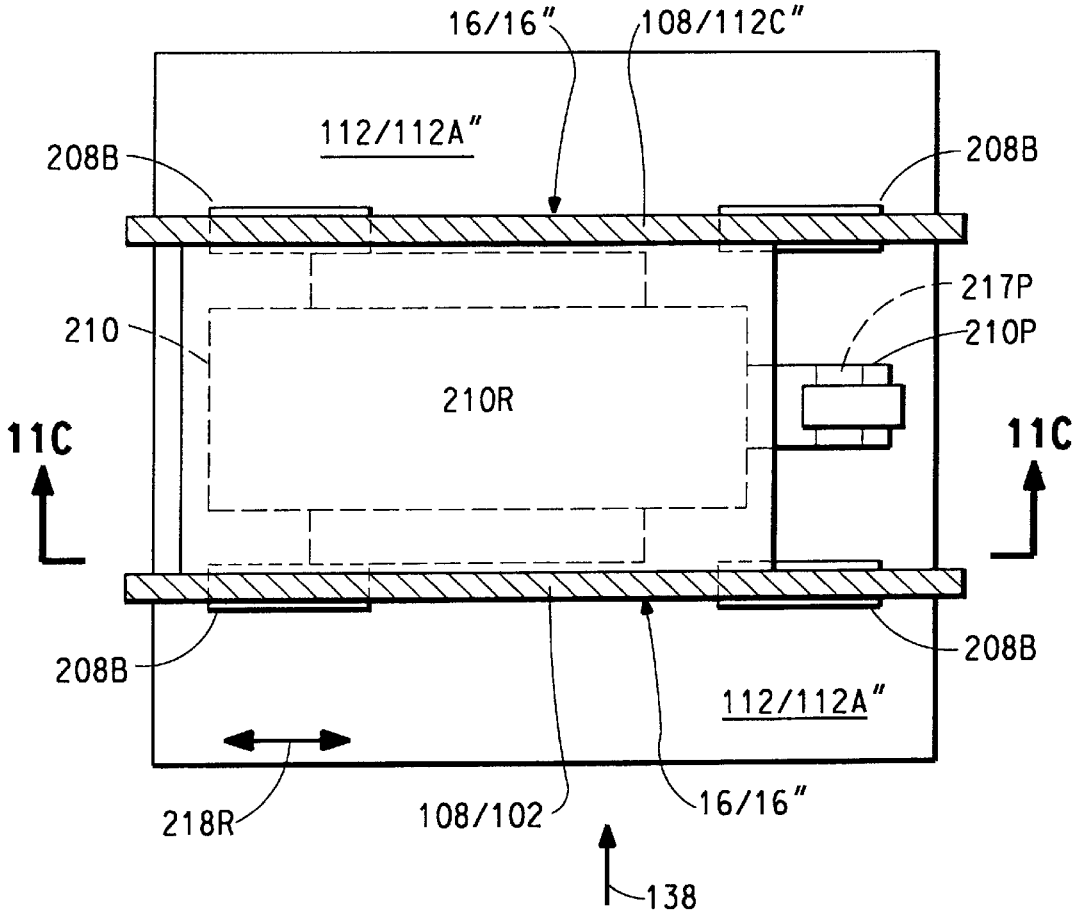
FIG. 11D is a top sectional view taken along section lines 11D—11D in FIG. 11C.

The platen 112/112A" is connected to a suitable source 210 of vibratory motion able to oscillate the platen 112/112A" in its own plane along either an orbital path 218V (FIG. 11B) or along a reciprocating transverse path 218R (FIG. 11D). When the source 210 is asserted the oscillation of the platen 112/112A" is transferred into the belt 134 moving rectilinearly therebeneath. The oscillation of the platen 112/112A" is imparted as additional vibratory motion to the belt 134. As a result the belt 134 provides additional scrubbing action at the interface between the belt 134 and the carpet. Rotation of the platen 112/112A" about its vertical central axis is restrained by the support members 208C.

In the modification of the invention shown in FIGS. 11A, 11B the source 210 takes the form of a orbital vibrator 210V. As diagrammatically indicated at 214 the orbital vibratory source 210V could be rigidly mounted to the structural framework of the housing 16/16". That is, when applied to the embodiment of FIGS. 6, 8 the orbital vibratory source 210V could be rigidly connected to one or both of the sidewall(s) of the beam 108. In the arrangement of FIGS. 10A, 10B the orbital vibratory source 210V could be rigidly connected to one or both of the brace plate 112C" and/or the bracket 102.

The rotating shaft 210S of the orbital vibratory source has a cam actuator 210C eccentrically mounted thereon. The cam actuator 210C is articuably connected to the platen 112/112A". In FIG. 11A, to effect the articuable connection the cam actuator 210C is received for rotation within a hollow recess 212R in a housing 212. The housing 212 is itself rigidly connected to the upper surface of the platen 112/112A". Overhanging lips 212L on the housing 212 capture and retain the cam actuator 210C within the recess 212R. As the cam actuator 210C rotates the platen 112/112A" oscillates in its own plane with an orbital diameter equal to the eccentric offset of the cam. The orbital path 218V of oscillation of the platen 112/112A" is indicated in the view of FIG. 11B. The oscillation of the platen 112/112A" is imparted as additional vibratory motion of the belt 134 as the same moves rectilinearly beneath the platen 112/112A".

Alternately, in FIGS. 11C and 11D the source 210 takes the form of a reciprocating vibrator 210R. The reciprocating vibratory source 210R could be rigidly mounted (as at 214) to a plate 215 connected into the structural framework of the housing. The plunger 210P of the reciprocating vibratory source 210R is oriented perpendicular to the direction 138 of travel of the belt 134. In FIG. 11C the restraint function of the support members is provided by leaf springs 208L, while bearing blocks 208B disposed between the framework and the platen 112/112A" support the load of the apparatus 10/10".

The free end of the plunger 210P is articuably connected, as by a pin 217P, to a lever 217 that is itself rigidly attached to the platen 112/112A". As the plunger 210P reciprocates the platen 112/112A" is correspondingly reciprocated along the path of travel 218R (FIG. 11D) extending perpendicularly to the rectilinear travel direction 138 of the belt 134. The reciprocating oscillation of the platen 112/112A" is imparted as additional vibratory motion into the belt 134 as the same moves rectilinearly beneath the platen.

It should be appreciated that in either FIGS. 11A/11B or in FIGS. 11C/11D the source 210 could be rigidly mounted to the platen 112/112A" and the necessary articuable connection effected between the source and the structure of the housing.

Figure 11E:
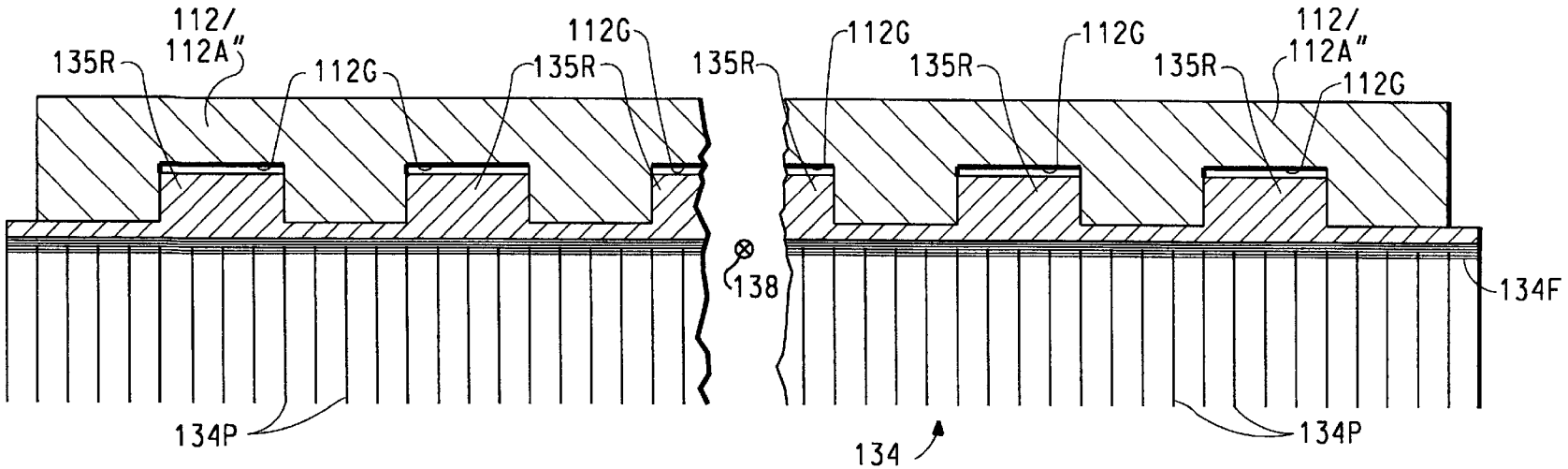
FIGS. 11E and 11F are front sectional views illustrating alternatives to enhance the coupling of the platen to the belt in the embodiments of FIGS. 11A and 11C.
Figure 11F:
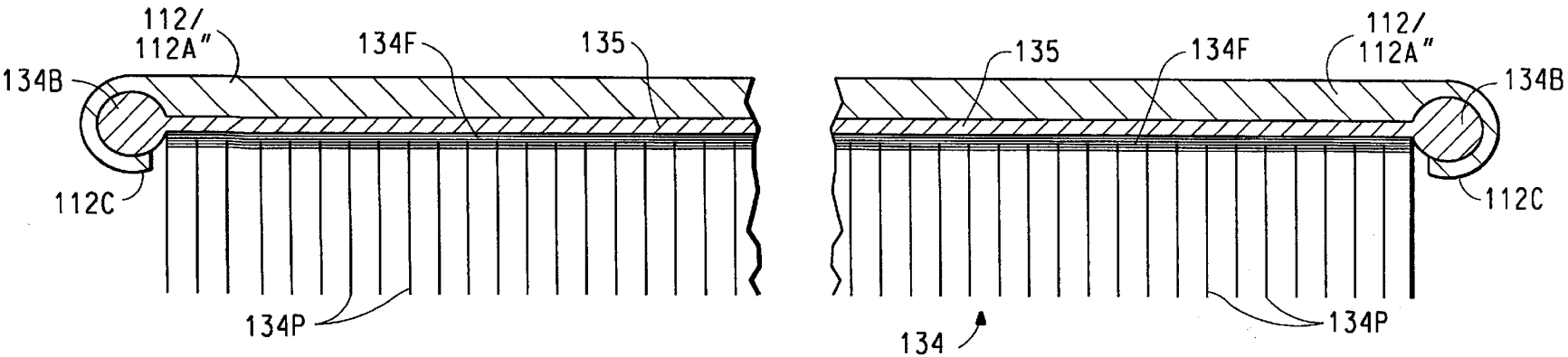

It is believed that the frictional interface between the platen and the belt is sufficient to couple the motion of the platen 112/112A" into the belt 134 to impart the additional vibratory motion to the belt to generate the additional desired agitating action. However, in some instances it may be advantageous to enhance the coupling between the platen 112/112A" and the belt 134. FIGS. 11E and 11F illustrate two possible configurations whereby this enhanced coupled may be achieved.

In FIG. 11E the lower surface of the platen 112/112A" has an array of grooves 112G that extend in parallel to the direction 138 of rectilinear motion of the belt 134. Correspondingly, the back surface of the substrate 134F of the belt 134 is provided with a ridged overlay 135. Each of the plurality of ridges 135R on the overlay 135 mates into one of the grooves 112G on the platen 112/112A". Thus, reciprocating transverse or orbital motion of the platen 112/112A" is more efficiently transferred to the belt 134 while the same is free to travel rectilinearly beneath the platen 112/112A".

Alternately the lateral margins of the platen 112/112A" have flanges that are formed into the shape of circular channels 112C. The channels 112C are sized to accept enlarged, circular beads 134B that extend along the lateral margins of an overlay 135 attached to the belt 134. With the beads 134B of the overlay 135 received within the channels 112C the reciprocating transverse or orbital motion of the platen 112/112A" is efficiently transferred to the belt 134 while the same freely moves rectilinearly beneath the platen 112/112A".

Those skilled in the art, having the benefit of the teachings of the present invention as set forth herein, may effect numerous modifications thereto. Such modifications are to be construed as lying within the contemplation of the present invention, as defined by the appended claims.

What is claimed is:

1. Apparatus for agitating a cleaning agent into a carpet comprising:

a housing (16);

a first and a second roller (76A, 76B) and an idler roller (116) each mounted within the housing (16) for rotation in a first angular direction with respect thereto, a platen (112) mounted within the housing (16) intermediate the first and second rollers (76A, 76B);

a belt (134) trained about the first and second rollers (76A, 76B) and the idler roller (116), the belt extending under the platen (112), the belt comprising a fabric substrate (134F) having a pile surface (134P) attached to the exterior surface thereof, the rollers (76A, 76B), the idler roller (116) and the platen (112) supporting rectilinear movement of the belt in the first direction (138) to bring a portion (140S) of the fabric surface (134P) sequentially from a first position (140A) within the housing (16) to a contacting position (140B) in which the portion of the fabric surface is in agitating contact with a carpet and, thereafter, to a second position (140C) within the housing.

2. The apparatus of claim 1 further comprising:

a suction head (36) disposed within the housing (16) at a position proximal to the second position (140C), the suction head lying within a predetermined close distance of the fabric surface (134P), the suction head being operative to remove from the fabric surface soil lifted from the carpet as a result of contact with the carpet.

3. The apparatus of claim 2 wherein the suction head has a lip (36F) thereon, and wherein the lip (36F) of the suction head contacts the fabric surface (134P).

4. The apparatus of claim 1 further comprising:

a pile lifting roller (48) mounted to the housing (16) for rotation in a second angular direction with respect to the housing, the second angular direction being opposed to the first angular direction, the pile lifting roller (48) having a bristle brush (50) thereon.

5. The apparatus of claim 4 wherein the bristles (50B) on the pile lifting roller (48) are engageable with the fabric surface.

6. The apparatus of claim 5 further comprising:

a suction head (36) disposed within the housing at a position proximal to the second position (140C) lying within a predetermined close distance of the fabric surface, the suction head being operative to remove from the fabric surface soil lifted from the carpet as a result of contact with the carpet.

7. The apparatus of claim 6 wherein the suction head has a first (36F) and a second lip (36R) thereon, and wherein the first lip (36F) of the suction head contacts the fabric surface along a first line of contact (144F), and wherein the second lip (36R) of the suction head contacts the bristles (50B) on the pile lifting roller (48) along a second line of contact (144R), whereby the first line of contact (144F), the second line of contact (144R) and the suction head (36) define a suction zone in which particulate matter ejected from the fabric surface and the bristle brush is drawn into the suction head.

8. The apparatus of claim 4 wherein the pile lifting roller (48) is hollow, and wherein a motive source for rotatably driving the pile lifting roller (48) with respect to the housing (16) is disposed within the hollow interior of the pile lifting roller.

9. The apparatus of claim 4 wherein the housing has a pair of slots (44) formed therein, the apparatus further comprising:

a block (46) for supporting the pile lifting roller (48), the block (46) including arms (46A) that engage the surface of the housing defining the slots (44), the block (46) being movable within the slots (44) in a first direction, the block (46) being formed of a first member (46M) and a second member (46C), one of the members (46M, 46C) being adjustable with respect to the other of the members (46C, 46M) in a second direction substantially perpendicular to the first direction.

10. The apparatus of claim 1 wherein at least one of the rollers (76F, 76R) is hollow, and wherein a motive source for rotatably driving the hollow roller (76F, 76R) with respect to the housing 16 is disposed within the hollow interior of the roller.

11. The apparatus of claim 1 further comprising:

a tensioning arrangement (102, 114, 126A, 126B) connected to the idler roller (116) for tensioning the belt (134).

12. The apparatus of claim 1 further comprising:

a dispenser (82) mounted to the housing in a position wherein a cleaning agent is dispensed onto the carpet surface.

13. The apparatus of claim 1 further comprising:

a dispenser (82) mounted to the housing in a position wherein a cleaning agent is dispensed onto the belt (134).

14. The apparatus of claim 1 further comprising:

a third and a fourth roller and a second idler roller mounted in the housing, a second platen mounted within the housing intermediate the third and fourth rollers;

a second belt trained about the third and fourth rollers and the second idler roller, the second belt extending under the second platen, the second belt comprising a fabric substrate having a pile surface attached on the exterior surface thereof, the third and fourth rollers, the idler roller and the platen supporting rectilinear movement of the second belt in the second direction opposed to the first direction.

15. The apparatus of claim 14 further comprising:

a dispenser disposed intermediate the first and the second belts.

16. The apparatus of claim 1 wherein the platen is rigidly attached to the housing.

17. The apparatus of claim 1 wherein the platen is within the housing such that the platen is movably mounted to the housing, the apparatus further comprising: a source of vibratory motion connected to the platen for oscillating the platen in its own plane with respect to the housing, the oscillation of the platen being imparted as additional vibratory motion to the belt as the belt moves beneath the platen.

18. The apparatus of claim 17 wherein the source of vibratory motion comprises an orbital vibrator operative to oscillate the platen along an orbital path.

19. The apparatus of claim 18 wherein the platen has an array of grooves therein, the grooves extending in parallel to the direction of rectilinear motion of the belt, and wherein the belt has an array of ridges thereon able to mate with the grooves in the platen thereby to couple the platen to the belt.

20. The apparatus of claim 18 wherein the platen has a circular channel along each lateral edge thereof, and wherein the belt has a bead disposed along each lateral edge thereof, the beads of the belt being receivable within the channels of the platen thereby to couple the platen to the belt.

21. The apparatus of claim 17 wherein the source of vibratory motion comprises a reciprocating orbital vibrator operative to oscillate the platen along a reciprocating path transverse to the direction of rectilinear motion of the belt.

22. The apparatus of claim 21 wherein the platen has an array of grooves therein, the grooves extending in parallel to the direction of rectilinear motion of the belt, and wherein the belt has an array of ridges thereon able to mate with the grooves in the platen thereby to couple the platen to the belt.

23. The apparatus of claim 21 wherein the platen has a circular channel along each lateral edge thereof, and wherein the belt has a bead disposed along each lateral edge thereof, the beads of the belt being receivable within the channels of the platen thereby to couple the platen to the belt.

24. The apparatus of claim 1 further comprising a yoke (114) rotationally mounted to the housing, and wherein one of the rollers is mounted on the yoke (114), further comprising, an adjustment mechanism for adjusting the position of the yoke with respect to the housing for maintaining the track of the belt on the roller.

25. Apparatus for agitating a cleaning agent into a carpet comprising:

a housing (16");

a first and a second roller (76R", 116") each mounted within the housing for rotation in a first angular direction with respect thereto, a platen (112") mounted within the housing intermediate the first and second rollers;

a belt (134) trained about the first and second rollers, the belt extending under the platen, the belt comprising a fabric substrate having a pile surface attached to the exterior surface thereof, the rollers and the platen supporting rectilinear movement of the belt in the first direction to bring a portion of the fabric surface sequentially from a first position within the housing to a contacting position in which the portion of the fabric surface is in agitating contact with a carpet and, thereafter, to a second position within the housing.

26. The apparatus of claim 25 further comprising:

a pile lifting roller mounted to the housing for rotation in a second angular direction with respect to the housing, the second angular direction being opposed to the first angular direction, the pile lifting roller having a bristle brush thereon, the bristles on the pile lifting roller being engageable with the fabric surface, and a suction head disposed within the housing at a position proximal to the second position lying within a predetermined close distance of the fabric surface, the suction head being operative to remove from the fabric surface soil lifted from the carpet as a result of contact with the carpet.

27. The apparatus of claim 25 further comprising:

a tensioning arrangement (102, 114, 126A, 126B) connected to the idler roller (116") for tensioning the belt (134).

28. The apparatus of claim 25 further comprising a yoke (114) rotationally mounted to the housing, and wherein one of the rollers is mounted on the yoke (114), further comprising, an adjustment mechanism for adjusting the position of the yoke with respect to the housing for maintaining the track of the belt on the roller.

29. The apparatus of claim 25 wherein the platen is rigidly attached to the housing.

30. The apparatus of claim 25 wherein the platen is within the housing such that the platen is movably mounted to the housing, the apparatus further comprising: a source of vibratory motion connected to the platen for oscillating the platen in its own plane with respect to the housing, the oscillation of the platen being imparted as additional vibratory motion to the belt as the belt moves beneath the platen.

31. The apparatus of claim 30 wherein the source of vibratory motion comprises an orbital vibrator operative to oscillate the platen along an orbital path.

32. The apparatus of claim 31 wherein the platen has an array of grooves therein, the grooves extending in parallel to the direction of rectilinear motion of the belt, and wherein the belt has an array of ridges thereon able to mate with the grooves in the platen thereby to couple the platen to the belt.

33. The apparatus of claim 31 wherein the platen has a circular channel along each lateral edge thereof, and wherein the belt has a bead disposed along each lateral edge thereof, the beads of the belt being receivable within the channels of the platen thereby to couple the platen to the belt.

34. The apparatus of claim 30 wherein the source of vibratory motion comprises a reciprocating orbital vibrator operative to oscillate the platen along a reciprocating path transverse to the direction of rectilinear motion of the belt.

35. The apparatus of claim 34 wherein the platen has an array of grooves therein, the grooves extending in parallel to the direction of rectilinear motion of the belt, and wherein the belt has an array of ridges thereon able to mate with the grooves in the platen thereby to couple the platen to the belt.

36. The apparatus of claim 34 wherein the platen has a circular channel along each lateral edge thereof, and wherein the belt has a bead disposed along each lateral edge thereof, the beads of the belt being receivable within the channels of the platen thereby to couple the platen to the belt.

* * * * *